US007079127B2

(12) United States Patent
Morita

(10) Patent No.: US 7,079,127 B2
(45) Date of Patent: Jul. 18, 2006

(54) REFERENCE VOLTAGE GENERATION CIRCUIT, DISPLAY DRIVER CIRCUIT, DISPLAY DEVICE, AND METHOD OF GENERATING REFERENCE VOLTAGE

(75) Inventor: Akira Morita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 553 days.

(21) Appl. No.: 10/354,999

(22) Filed: Jan. 31, 2003

(65) Prior Publication Data

US 2003/0151617 A1 Aug. 14, 2003

(30) Foreign Application Priority Data

Feb. 8, 2002 (JP) ..... 2002-032678

(51) Int. Cl.
*G09G 5/00* (2006.01)
*G09G 3/36* (2006.01)

(52) U.S. Cl. ..... 345/212; 345/89; 345/210; 345/211

(58) Field of Classification Search ..... 345/88, 345/211, 72, 83, 89, 204, 212, 87, 210
See application file for complete search history.

(56) References Cited

U.S. PATENT DOCUMENTS 5,745,092 A 4/1998 Ito
5,859,633 A 1/1999 Kim
5,867,057 A 2/1999 Hsu et al.
5,956,006 A * 9/1999 Sato ..... 345/88

(Continued)

FOREIGN PATENT DOCUMENTS

EP 1 014 333 A1 6/2000

(Continued)

OTHER PUBLICATIONS

Furuhashi et al., "A 64-Gray-Scale Digital Signal Driver for Color TFT-LCDS", SID International Symposium Digest of Technical Papers. San Jose, Jun. 14-16, 1994, Santa Ana, SID, US, vol. 25, Jun. 14, 1994, pp. 359-362.

(Continued)

*Primary Examiner*—Sumati Lefkowitz
*Assistant Examiner*—Alecia D. Nelson
(74) *Attorney, Agent, or Firm*—Oliff & Berridge, PLC

(57) ABSTRACT

A reference voltage generation circuit outputs multi-valued reference voltages by a ladder resistance circuit connected between a first power supply line to which a power supply voltage on the high potential side is supplied and a second power supply line to which a power supply voltage on the low potential side is supplied. The ladder resistance circuit is formed by connecting a plurality of resistance circuits in series. A first impedance variable circuit of the reference voltage generation circuit changes a first impedance value (resistance value) between the first power supply line and a jth (j is an integer) divided node. A second impedance variable circuit in the reference voltage generation circuit changes a second impedance value (resistance value) between the kth ($1 \leqq j < k \leqq i$, k is an integer) divided node and the second power supply line.

28 Claims, 30 Drawing Sheets

U.S. PATENT DOCUMENTS

| | | | | |
|---|---|---|---|---|
| 6,225,992 | B1 * | 5/2001 | Hsu et al. | 345/211 |
| 6,256,025 | B1 * | 7/2001 | Imai et al. | 345/211 |
| 6,275,207 | B1 | 8/2001 | Nitta et al. | |
| 6,304,255 | B1 * | 10/2001 | Suzuki et al. | 345/211 |
| 6,864,869 | B1 * | 3/2005 | Udo et al. | 345/89 |
| 2002/0008684 | A1 * | 1/2002 | Udo et al. | 345/89 |
| 2004/0119677 | A1 * | 6/2004 | Nakamura et al. | 345/89 |
| 2005/0024358 | A1 * | 2/2005 | Tsuchiya | 345/211 |

FOREIGN PATENT DOCUMENTS

| | | |
|---|---|---|
| EP | 1 094 440 A2 | 4/2001 |
| JP | 54-005399 | 1/1979 |

OTHER PUBLICATIONS

U.S. Appl. No. 10/348,944, filed Jan. 23, 2003, Morita.
U.S. Appl. No. 10/349,091, filed Jan. 23, 2003, Morita.
U.S. Appl. No. 10/355,298, filed Jan. 31, 2003, Morita.

* cited by examiner

V0
V1
V2
V3
V4
92-0
92-1
92-2
92-3
90-01
90-02
90-03
90-04
90-11
90-12
90-13
90-14
90-21
90-22
90-23
90-24
90-31
90-32
90-33
90-34
20K
16K
12K
8K
6K
4K
2K
5K
1K
500
250
R4
ND1
ND2
ND3
ND4
VR0
VR1
VR2
VR3

90-01 RESISTANCE SWITCHING CIRCUIT
VARIABLE RESISTANCE CIRCUIT
V0
V1
V2
V3
V4
90-03
90-04
90-02
90-13
90-14
90-23
90-24
90-12
90-11
90-22
90-21
90-32
90-31
90-33
90-34
20K
16K
12K
8K
6K
4K
2K
5K
1K
500
250
R4
ND1
ND2
ND3
ND4
VR0
VR1
VR2
VR3

V0
V1
V2
V3
V4
VR0
VR1
VR2
VR3
ND1
ND2
ND3
ND4
R4

REFERENCE VOLTAGE GENERATION CIRCUIT, DISPLAY DRIVER CIRCUIT, DISPLAY DEVICE, AND METHOD OF GENERATING REFERENCE VOLTAGE

Japanese Patent Application No. 2002-32678 filed on Feb. 8, 2002, is hereby incorporated by reference in its entirety.

BACKGROUND OF THE INVENTION

The present invention relates to a reference voltage generation circuit, a display driver circuit, a display device, and a method for generating a reference voltage.

A decrease in size and an increase in resolution have been demanded for a display device represented by an electro-optical device such as a liquid crystal device. In particular, a liquid crystal device realizes a decrease in power consumption and has been generally used for portable electronic equipment. In the case where a liquid crystal device is used as a display section of a portable telephone, image display with a rich color tone due to an increase of number of grayscale levels is required.

BRIEF SUMMARY OF THE INVENTION

According to one aspect of the present invention, there is provided a reference voltage generation circuit which generates multi-valued reference voltages for generating grayscale values which are gamma-corrected based on grayscale data, comprising:

a ladder resistance circuit which comprises a plurality of resistance circuits connected in series between first and second power supply lines to which first and second power supply voltages are respectively supplied, and outputs voltages of first to ith (i is an integer of two or more) divided nodes, which are formed by dividing the ladder resistance circuit by the resistance circuits, as first to ith reference voltages;

a first impedance variable circuit which changes a first impedance value which is an impedance between jth (j is an integer) divided node and the first power supply line; and a second impedance variable circuit which changes a second impedance value which is an impedance between kth ($1 \leqq j < k \leqq < i$, k is an integer) divided node and the second power supply line, wherein the first and second impedance variable circuits decrease the first and second impedance values during a given control period in a drive period based on the grayscale data, and wherein the first and second impedance variable circuits return the first and second impedance values to given first and second values after the control period has elapsed.

According to another aspect of the present invention, there is provided a reference voltage generation circuit which generates multi-valued reference voltages for generating grayscale values which are gamma-corrected based on grayscale data, comprising:

a ladder resistance circuit which comprises a plurality of resistance circuits connected in series between first and second power supply lines to which first and second power supply voltages are respectively supplied, and outputs voltages of first to ith (i is an integer of two or more) divided nodes, which are formed by dividing the ladder resistance circuit by the resistance circuits, as first to ith reference voltages;

a first switching circuit group which changes impedance of the resistance circuits disposed between the first power supply line and the jth (j is an integer) divided node among the plurality of resistance circuits; and a second switching circuit group which changes impedance of the resistance circuits disposed between the second power supply line and the kth ($1 \leqq j < k \leqq i$, k is an integer) divided node among the plurality of resistance circuits, wherein the first and second switching circuit groups decrease the impedance of the resistance circuits during a given control period in a drive period based on the grayscale data, and increase the impedance of the resistance circuits after the control period has elapsed.

According to still another aspect of the present invention, there is provided a method of generating a reference voltage for generating multi-valued reference voltages for generating grayscale values which are gamma-corrected based on grayscale data, the method comprising:

providing a ladder resistance circuit which outputs voltages of first to ith (i is an integer of two or more) divided nodes which are formed by dividing the ladder resistance circuit by a plurality of resistance circuits connected in series between first and second power supply lines to which first and second power supply voltages are respectively supplied as first to ith reference voltages, and decreasing a resistance value between the jth (j is an integer) divided node and the first power supply line and a resistance value between the kth ($1 \leqq j < k \leqq i$, k is an integer) divided node and the second power supply line during a given control period in a drive period based on the grayscale data.

DETAILED DESCRIPTION OF THE EMBODIMENT

Figure 1:
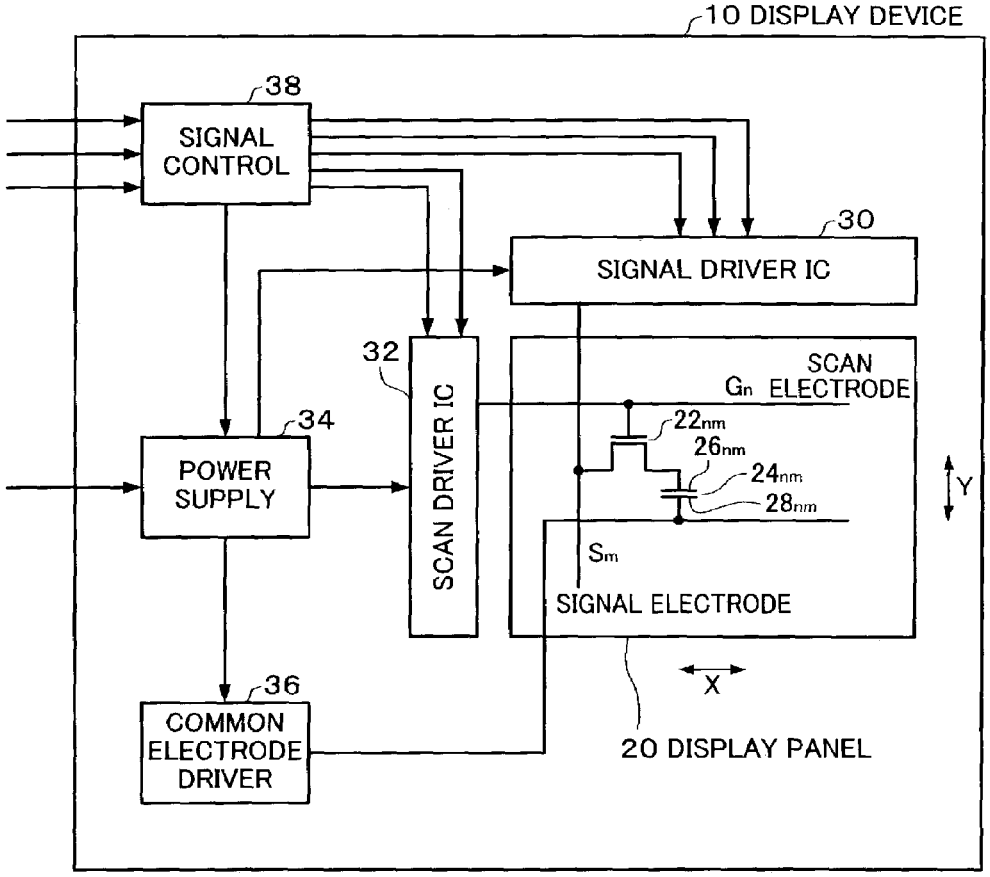
FIG. 1 is a configuration diagram showing an outline of a configuration of a display device to which a display driver circuit including a reference voltage generation circuit in an embodiment of the present invention is applied.

Embodiments of the present invention are described below. However, the embodiments described below should not be construed as limiting the scope of the present invention described in the claims. The entire configuration described below is not necessarily indispensable for the present invention.

Generally, an image signal for displaying an image is gamma-corrected corresponding to display characteristics of a display device. Gamma correction is performed by a gamma correction circuit (reference voltage generation circuit in a broad sense). Taking a liquid crystal device as an example, the gamma correction circuit generates a voltage corresponding to the transmittance ratio of a pixel based on grayscale data for performing grayscale display.

The gamma correction circuit may be formed by using ladder resistance. In this case, voltages across both ends of respective resistance circuits constituting the ladder resistance are output as multi-valued reference voltages corresponding to the grayscale values. However, since current steadily flows through the ladder resistance, the resistance value of the ladder resistance needs to be increased in order to decrease current consumption.

However, an increase in the resistance value of the ladder resistance results in an increase in charge time depending on the time constant determined by parasitic capacitance of a reference voltage output node and the resistance value of the ladder resistance. Therefore, in the case where the reference voltages need to be generated in a constant cycle such as in polarity inversion driving, there may be a case where a sufficient charge time cannot be secured.

The following embodiments may provide a reference voltage generation circuit which can secure a charge time necessary for driving and decrease current consumption by a ladder resistance used for gamma correction, a display driver circuit, a display device, and a method for generating a reference voltage can be provided.

According to one embodiment of the present invention, there is provided a reference voltage generation circuit which generates multi-valued reference voltages for generating grayscale values which are gamma-corrected based on grayscale data, comprising:

a ladder resistance circuit which comprises a plurality of resistance circuits connected in series between first and second power supply lines to which first and second power supply voltages are respectively supplied, and outputs voltages of first to ith (i is an integer of two or more) divided nodes, which are formed by dividing the ladder resistance circuit by the resistance circuits, as first to ith reference voltages;

a first impedance variable circuit which changes a first impedance value which is an impedance between jth (j is an integer) divided node and the first power supply line; and a second impedance variable circuit which changes a second impedance value which is an impedance between kth ($1 \leqq j < k \leqq i$, k is an integer) divided node and the second power supply line, wherein the first and second impedance variable circuits decrease the first and second impedance values during a given control period in a drive period based on the grayscale data, and wherein the first and second impedance variable circuits return the first and second impedance values to given first and second values after the control period has elapsed.

In this embodiment, in order to generate the gamma-corrected multi-valued reference voltages, the voltages of the first to ith divided nodes which are formed by dividing the ladder resistance circuit by the resistance circuits connected in series between the first and second power supply lines are output as the first to ith reference voltages. The impedance value between the first power supply line and the jth divided node is variably controlled by the first impedance variable circuit, and the impedance value between the second power supply line and the kth divided node is variably controlled by the second impedance variable circuit. The first and second impedance values are decreased during a given control period in the drive period, and the first and second impedance values are returned to given first and second values after the control period has elapsed.

In the case of performing gamma correction according to grayscale characteristics, the resistance values of the resistance circuits constituting the ladder resistance circuit are generally increased as the distance from the first and second power supply lines is decreased. Therefore, the time constant can be decreased during the control period by decreasing the impedance from the power supply by variably controlling the impedance by using the first and second impedance variable circuits, and the time constant can be returned to the original time constant after the control period has elapsed. This enables the charge time to be decreased, whereby a desired reference voltage can be rapidly obtained. Therefore, the reference voltage generation circuit is suitably used in the case where the reference voltage is frequently changed such as in a polarity inversion driving method. Moreover, since the resistance values of the resistance circuits of the ladder resistance circuit can be increased, current consumption can be decreased, whereby a decrease in power consumption can be achieved.

In the reference voltage generation circuit according to this embodiment, the first impedance variable circuit may comprise a first resistance bypass circuit inserted between the first power supply line and the jth divided node, the first resistance bypass circuit may electrically connect the first power supply line with the jth divided node during the control period, and the first resistance bypass circuit may electrically disconnect the first power supply line from the jth divided node after the control period has elapsed.

According to this embodiment, since the impedance from the power supply to the jth divided node can be decreased by providing the, first resistance bypass circuit, the configuration can be simplified while achieving the above effects.

In the reference voltage generation circuit according to this embodiment, the first impedance variable circuit may comprise first to jth switching circuits which respectively bypass the first power supply line with the first to jth divided nodes, and the first to jth switching circuits may sequentially disconnect the jth to first divided nodes electrically from the first power supply line after electrically connecting the first power supply line with all of the first to jth divided nodes.

According to this embodiment, after decreasing the impedance from the power supply to the jth divided node by the first to jth switching circuits, the impedance is returned to the original value by allowing the jth to first switching circuits to be sequentially turned OFF. Therefore, the divided nodes can be allowed to rapidly reach the desired reference voltages without accompanying a rapid change in the impedance.

In the reference voltage generation circuit according to this embodiment, the first impedance variable circuit may comprise:

first to (j−1)th voltage follower type operational amplifiers of which inputs are connected with the first to (j−1)th divided nodes;

first to (j−1)th drive output-switching circuits inserted between outputs of the first to (j−1)th voltage follower type operational amplifiers and first to (j−1)th reference voltage output nodes;

first to (j−1)th resistance output-switching circuits inserted between the first to (j−1)th divided nodes and the first to (j−1)th reference voltage output nodes; and a first bypass switching circuit inserted between the output of the (j−1)th voltage follower type operational amplifier and the jth reference voltage output node, the first to (j−1)th drive output-switching circuits may electrically connect the outputs of the first to (j−1)th voltage follower type operational amplifiers with the first to (j−1)th reference voltage output nodes during the control period, the first to (j−1)th drive output-switching circuits may electrically disconnect the outputs of the first to (j−1)th voltage follower type operational amplifiers from the first to (j−1)th reference voltage output nodes after the control period has elapsed, the first to (j−1)th resistance output-switching circuits may electrically disconnect the first to (j−1)th divided nodes from the first to (j−1)th reference voltage output nodes during the control period, the first to (j−1)th resistance output-switching circuits may electrically connect the first to (j−1)th divided nodes with the first to (j−1)th reference voltage output nodes after the control period has elapsed, the first bypass switching circuit may electrically connect the output of the (j−1)th voltage follower type operational amplifier with the jth reference voltage output node during the control period, and the first bypass switching circuit may electrically disconnect the output of the (j−1)th voltage follower type operational amplifier from the jth reference voltage output node after the control period has elapsed.

According to this embodiment, the impedance can be transformed by using the first to (j−1)th voltage follower type operational amplifiers, and the jth reference voltage output node can be short-circuited with the output of the (j−1)th voltage follower type operational amplifier by using the first bypass switching circuit. Therefore, the impedance from the power supply to the first to jth divided nodes can be decreased. In particular, use of the voltage follower type operational amplifier enables the reference voltage output node to be driven at high speed, whereby the desired reference voltage can be supplied even if the drive period is decreased.

In the reference voltage generation circuit according to this embodiment, the first impedance variable circuit may comprise:

first to (j−1)th voltage follower type operational amplifiers of which inputs are connected with the first to (j−1)th divided nodes;

first to (j−1)th drive output-switching circuits inserted between outputs of the first to (j−1)th voltage follower type operational amplifiers and first to (j−1)th reference voltage output nodes;

first to (j−1)th resistance output-switching circuits inserted between the first to (j−1)th divided nodes and the first to (j−1)th reference voltage output nodes; and a first operational amplifier circuit inserted between the output of the (j−1)th voltage follower type operational amplifier and the jth reference voltage output node, the first to (j−1)th drive output-switching circuits may electrically connect the outputs of the first to (j−1)th voltage follower type operational amplifiers with the first to (j−1)th reference voltage output nodes during the control period, the first to (j−1)th drive output-switching circuits may electrically disconnect the outputs of the first to (j−1)th voltage follower type operational amplifiers from the first to (j−1)th reference voltage output nodes after the control period has elapsed, the first to (j−1)th resistance output-switching circuits may electrically disconnect the first to (j−1)th divided nodes from the first to (j−1)th reference voltage output nodes during the control period, the first to (j−1)th resistance output-switching circuits may electrically connect the first to (j−1)th divided nodes with the first to (j−1)th reference voltage output nodes after the control period has elapsed, the first operational amplifier circuit may output a voltage that is the output of the (j−1)th voltage follower type operational amplifier added with a given offset voltage, to the jth reference voltage output node during the control period, and an operating current of the first operational amplifier circuit may be limited or terminated after the control period has elapsed.

According to this embodiment, the impedance is transformed by using the first to (j−1)th voltage follower type operational amplifiers, and the jth reference voltage output node is driven while adding an offset by the first operational amplifier circuit. Therefore, the impedance from the power supply to the first to jth divided nodes can be decreased. Moreover, the jth divided node can be set at the desired jth reference voltage with high accuracy. In particular, use of the voltage follower type operational amplifier enables the reference voltage output node to be driven at high speed, whereby a desired reference voltage can be supplied even if the drive period is decreased. Furthermore, since the first operational amplifier circuit is driven only in a necessary period by controlling the operating current of the first operational amplifier circuit, an increase in current consumption can be prevented.

In the reference voltage generation circuit according to this embodiment, the second impedance variable circuit may comprise a second resistance bypass circuit inserted between the second power supply line and the kth divided node, the second resistance bypass circuit may electrically connects the second power supply line with the kth divided node during the control period, and the second resistance bypass circuit may electrically disconnects the second power supply line from the kth divided node after the control period has elapsed.

According to this embodiment, since the impedance from the power supply to the kth divided node can be decreased by providing the second resistance bypass circuit, a sufficient charge time can be secured and the resistance values of the resistance circuits of the ladder resistance circuit can be increased. In addition, the configuration can be simplified.

In the reference voltage generation circuit according to this embodiment, the second impedance variable circuit may comprise kth to ith switching circuits which respectively bypass the second power supply line with the kth to ith divided nodes, and the kth to ith switching circuits may sequentially disconnect the kth to ith divided nodes electrically from the second power supply line after electrically connecting the second power supply line with the kth to ith divided nodes.

According to this embodiment, after decreasing the impedance from the power supply to the kth divided node by using the kth to ith switching circuits, the impedance is returned to the original value by allowing the kth to ith switching circuits to be sequentially turned OFF. Therefore, the divided nodes can be allowed to rapidly reach the desired reference voltages without accompanying a rapid change in the impedance.

In the reference voltage generation circuit according to this embodiment, the second impedance variable circuit may comprise:

(k+1)th to ith voltage follower type operational amplifiers of which inputs are connected with the (k+1)th to ith divided nodes;

(k+1)th to ith drive output-switching circuits inserted between outputs of the (k+1)th to ith voltage follower type operational amplifiers and (k+1)th to ith reference voltage output nodes;

(k+1)th to ith resistance output-switching circuits inserted between the (k+1)th to ith divided nodes and the (k+1)th to ith reference voltage output nodes; and a second bypass switching circuit inserted between the output of the (k+1)th voltage follower type operational amplifier and the kth reference voltage output node, the (k+1)th to ith drive output-switching circuits may electrically connect the outputs of the (k+1)th to ith voltage follower type operational amplifiers with the (k+1)th to ith reference voltage output nodes during the control period, the (k+1)th to ith drive output-switching circuits may electrically disconnect the outputs of the (k+1)th to ith voltage follower type operational amplifiers from the (k+1) th to ith reference voltage output nodes after the control period has elapsed, the (k+1)th to ith resistance output-switching circuits may electrically disconnect the (k+1)th to ith divided nodes from the (k+1)th to ith reference voltage output nodes during the control period, the (k+1)th to ith resistance output-switching circuits may electrically connect the (k+1)th to ith divided nodes with the (k+1)th to ith reference voltage output nodes after the control period has elapsed, the second bypass switching circuit electrically may connect the output of the (k+1)th voltage follower type operational amplifier with the kth reference voltage output node during the control period, and the second bypass switching circuit electrically may disconnect the output of the (k+1)th voltage follower type operational amplifier from the kth reference voltage output node after the control period has elapsed.

According to this embodiment, the impedance can be transformed by using the (k+1)th to ith voltage follower type operational amplifiers, and the kth reference voltage output node can be short-circuited with the output of the (k+1)th voltage follower type operational amplifier by the second bypass switching circuit. Therefore, the impedance from the power supply to the kth to ith divided nodes can be decreased. In particular, use of the voltage follower type operational amplifier enables the reference voltage output node to be driven at high speed, whereby the desired reference voltage can be supplied even if the drive period is decreased.

In the reference voltage generation circuit according to this embodiment, the second impedance variable circuit may comprise:

(k+1)th to ith voltage follower type operational amplifiers of which inputs are connected with the (k+1)th to ith divided nodes;

(k+1)th to ith drive output-switching circuits inserted between outputs of the (k+1)th to ith voltage follower type operational amplifiers and (k+1)th to ith reference voltage output nodes;

(k+1)th to ith resistance output-switching circuits inserted between the (k+1)th to ith divided nodes and the (k+1)th to ith reference voltage output nodes; and a second bypass switching circuit inserted between the output of the (k+1)th voltage follower type operational amplifier and the kth reference voltage output node, the (k+1)th to ith drive output-switching circuits may electrically connect the outputs of the (k+1)th to ith voltage follower type operational amplifiers with the (k+1)th to ith reference voltage output nodes during the control period, the (k+1)th to ith drive output-switching circuits may electrically disconnect the outputs of the (k+1)th to ith voltage follower type operational amplifiers from the (k+1) th to ith reference voltage output nodes after the control period has elapsed, the (k+1)th to ith resistance output-switching circuits may electrically disconnect the (k+1)th to ith divided nodes from the (k+1)th to ith reference voltage output nodes during the control period, the (k+1)th to ith resistance output-switching circuits may electrically connect the (k+1)th to ith divided nodes with the (k+1)th to ith reference voltage output nodes after the control period has elapsed, the second bypass switching circuit may electrically connect the output of the (k+1)th voltage follower type operational amplifier with the kth reference voltage output node during the control period, and the second bypass switching circuit may electrically disconnect the output of the (k+1)th voltage follower type operational amplifier from the kth reference voltage output node after the control period has elapsed.

According to this embodiment, the impedance is transformed by using the (k+1)th to ith voltage follower type operational amplifiers, and the kth reference voltage output node is driven while adding an offset voltage by the second operational amplifier circuit. Therefore, the impedance from the power supply to the kth to ith divided nodes can decreased. Moreover, the kth divided node can be set at the desired kth reference voltage with high accuracy. In particular, use of the voltage follower type operational amplifier enables the reference voltage output node to be driven at high speed, whereby the desired reference voltage can be supplied even if the drive period is decreased. Furthermore, since the second operational amplifier circuit is driven only in a necessary period by controlling the operating current of the second operational amplifier circuit, an increase in current consumption can be prevented.

According to another embodiment of the present invention, there is provided a reference voltage generation circuit which generates multi-valued reference voltages for generating grayscale values which are gamma-corrected based on grayscale data, comprising:

a ladder resistance circuit which comprises a plurality of resistance circuits connected in series between first and second power supply lines to which first and second power supply voltages are respectively supplied, and outputs voltages of first to ith (i is an integer of two or more) divided nodes, which are formed by dividing the ladder resistance circuit by the resistance circuits, as first to ith reference voltages;

a first switching circuit group which changes impedance of the resistance circuits disposed between the first power supply line and the jth (j is an integer) divided node among the plurality of resistance circuits; and a second switching circuit group which changes impedance of the resistance circuits disposed between the second power supply line and the kth ($1 \leqq j < k \leqq i$, k is an integer) divided node among the plurality of resistance circuits, wherein the first and second switching circuit groups decrease the impedance of the resistance circuits during a given control period in a drive period based on the grayscale data, and increase the impedance of the resistance circuits after the control period has elapsed.

In this embodiment, the impedance of the resistance circuit of the ladder resistance circuit from the first power supply line to the jth divided node and the impedance of the resistance circuit from the second power supply line to the kth divided node are variably controlled by using the first and second switching circuit groups. For example, the impedance may be variably controlled by using the switching circuits by connecting each resistance circuit with the switching circuit either in series or in parallel. In this case, the time constant can be decreased by decreasing the impedance during the control period, and the time constant can be returned to the original time constant after the control period has elapsed. This enables the charge time to be decreased, whereby the divided node can be allowed to rapidly reach the desired reference voltage. Therefore, the reference voltage generation circuit is suitably used in the case where the reference voltage is frequently changed such as in a polarity inversion driving method. Moreover, since the resistance values of the resistance circuits of the ladder resistance circuit can be increased, current consumption can be decreased, whereby a decrease in power consumption can be achieved.

According to further embodiment of the present invention, there is provided a display driver circuit comprising:

any of the above reference voltage generation circuits, a voltage select circuit which selects a voltage from multi-valued reference voltages generated by the reference voltage generation circuit based on grayscale data; and a signal electrode driver circuit which drives a signal electrode by using the voltage selected by the voltage select circuit.

According to this embodiment, a display driver circuit capable of performing gamma correction even if the drive period is short and providing decreased power consumption can be provided.

According to still another embodiment of the present invention, there is provided a display device comprising:

a plurality of signal electrodes, a plurality of scan electrodes intersecting the signal electrodes, pixels specified by the signal electrodes and the scan electrodes, the above display driver circuit which drives the signal electrodes, and a scan electrode driver circuit which drives the scan electrodes.

According to this embodiment, a display device having a rich color tone and capable of decreasing power consumption can be provided.

According to still further embodiment of the present invention, there is provided a display device comprising:

a display panel including a plurality of signal electrodes, a plurality of scan electrodes intersecting the signal electrodes, and pixels specified by the signal electrodes and the scan electrodes;

the above display driver circuit which drives the signal electrodes, and a scan electrode driver circuit which drives the scan electrodes.

According to this embodiment, a display device having a rich color tone and capable of decreasing power consumption can be provided.

According to yet another embodiment of the present invention, there is provided a method of generating a reference voltage for generating multi-valued reference voltages for generating grayscale values which are gamma-corrected based on grayscale data, the method comprising:

providing a ladder resistance circuit which outputs voltages of first to ith (i is an integer of two or more) divided nodes which are formed by dividing the ladder resistance circuit by a plurality of resistance circuits connected in series between first and second power supply lines to which first and second power supply voltages are respectively supplied as first to ith reference voltages, and decreasing a resistance value between the jth (j is an integer) divided node and the first power supply line and a resistance value between the kth ($1 \leqq j < k \leqq i$, k is an integer) divided node and the second power supply line during a given control period in a drive period based on the grayscale data.

In this embodiment, in order to generate the gamma-corrected multi-valued reference voltages, the voltages of the first to ith divided nodes which are formed by dividing the ladder resistance circuit by the resistance circuits connected in series between the first and second power supply lines are output as the first to ith reference voltages. The resistance value between the jth divided node and the first power supply line and the resistance value between the kth divided node and the second power supply line are decreased in the given control period of the drive period.

In the case of performing gamma correction according to the grayscale characteristics, the resistance values of the resistance circuits of the ladder resistance circuit are generally increased as the distance from the first and second power supply lines is decreased. Therefore, the time constant can be decreased by decreasing the impedance during the control period, and the time constant can be returned to the original time constant after the control period has elapsed by variably controlling the resistance values as described above. This enables the charge time to be decreased, whereby the divided node can be allowed to rapidly reach the desired reference voltage. Therefore, this method is suitably used in the case where the reference voltage is frequently changed such as in a polarity inversion driving method. Moreover, since the resistance values of the resistance circuits of the ladder resistance circuit can be increased, current consumption can be decreased, whereby a decrease in power consumption can be achieved.

Embodiments of the present invention are described below in detail with reference to the drawings.

A reference voltage generation circuit in the following embodiments may be used as a gamma correction circuit. The gamma correction circuit is included in a display driver circuit. The display driver circuit may be used to drive an electro-optical device of which optical characteristics are changed by application of a voltage such as a liquid crystal device.

Although embodiments of the reference voltage generation circuit of the present invention applied to a liquid crystal device will be described below, the present invention is not limited thereto, and it can equally well be applied to other display devices.

1. Display Device

FIG. 1 shows an outline of a configuration of a display device to which a display driver circuit including a reference voltage generation circuit in the present embodiment is applied.

A display device (electro-optical device or liquid crystal device in a narrow sense) 10 may include a display panel (liquid-crystal panel in a narrow sense) 20.

The display panel 20 is formed on a glass substrate, for example. A plurality of scan electrodes (gate lines) $G_1$ to $G_N$ (N is an integer of two or more) which are arranged in the Y direction and extend in the X direction, and a plurality of signal electrodes (source lines) $S_1$ to $S_M$ (M is an integer of two or more) which are arranged in the X direction and extend in the Y direction are disposed on the glass substrate. A pixel region (pixel) is provided corresponding to the intersection point between the scan electrode $G_n$ ($1 \leqq n \leqq N$, n is an integer) and the signal electrode $S_m$ ($1 \leqq m \leqq M$, m is an integer). A thin film transistor (hereinafter abbreviated as "TFT") $\mathbf{22}_{nm}$ is disposed in the pixel region.

A gate electrode of the TFT $\mathbf{22}_{nm}$ is connected with the scan electrode $G_n$. A source electrode of the TFT $\mathbf{22}_{nm}$ is connected with the signal electrode $S_m$. A drain electrode of the TFT $\mathbf{22}_{nm}$ is connected with a pixel electrode $\mathbf{26}_{nm}$ of a liquid crystal capacitance (liquid crystal element in a broad sense) $\mathbf{24}_{nm}$.

The liquid crystal capacitance $\mathbf{24}_{nm}$ is formed by sealing a liquid crystal between the pixel electrode $\mathbf{26}_{nm}$ and a common electrode $\mathbf{28}_{nm}$ opposite thereto. The transmittance (transmittance ratio) of the pixel is changed corresponding to a voltage applied between these electrodes. A common electrode voltage Vcom is supplied to the common electrode $\mathbf{28}_{nm}$.

The display device 10 may include a signal driver IC 30. The display driver circuit in the present embodiment may be used as the signal driver IC 30. The signal driver IC 30 drives the signal electrodes $S_1$ to $S_M$ of the display panel 20 based on image data.

The display device 10 may include a scan driver IC 32. The scan driver IC 32 sequentially drives the scan electrodes $G_1$ to $G_N$ of the display panel 20 in one vertical scanning period.

The display device 10 may include a power supply circuit 34. The power supply circuit 34 generates a voltage necessary for driving the signal electrode and supplies the voltage to the signal driver IC 30. The power supply circuit 34 generates a voltage necessary for driving the scan electrode and supplies the voltage to the scan driver IC 32. The power supply circuit 34 generates the common electrode voltage Vcom.

The display device 10 may include a common electrode driver circuit 36. The common electrode voltage Vcom generated by the power supply circuit 34 is supplied to the common electrode driver circuit 36. The common electrode driver circuit 36 outputs the common electrode voltage Vcom to the common electrode of the display panel 20.

The display device 10 may include a signal control circuit 38. The signal control circuit 38 controls the signal driver IC 30, the scan driver IC 32, and the power supply circuit 34 according to the contents set by a host such as a central processing unit (hereinafter abbreviated as "CPU") (not shown). For example, the signal control circuit 38 supplies the setting of the operation mode, or a vertical synchronization signal or a horizontal synchronization signal generated therein to the signal driver IC 30 and the scan driver IC 32. The signal control circuit 38 controls polarity inversion timing of the power supply circuit 34.

In FIG. 1, the display device 10 includes the power supply circuit 34, the common electrode driver circuit 36, and the signal control circuit 38. However, at least one of these circuits may be provided outside the display device 10. The display device 10 may include the host.

In FIG. 1, at least either the display driver circuit having a function of the signal driver IC 30 or the scan electrode driver circuit having a function of the scan driver IC 32 may be formed on the glass substrate on which the display panel 20 is formed.

In the display device 10 having the above-described configuration, the signal driver IC 30 outputs a voltage corresponding to grayscale data to the signal electrode for performing grayscale display based on the grayscale data. The signal driver IC 30 gamma-corrects the voltage to be output to the signal electrode based on the grayscale data.

Therefore, the signal driver IC 30 includes a reference voltage generation circuit (gamma correction circuit in a narrow sense) for performing gamma correction.

Generally, grayscale characteristics of the display panel 20 differ depending on the structure of the display panel or a liquid crystal material used therefor. Specifically, the relation between the voltage which should be applied to the liquid crystal and the transmittance of the pixel does not become uniform. Therefore, gamma correction is performed by the reference voltage generation circuit in order to generate an optimum voltage which should be applied to the liquid crystal corresponding to the grayscale data.

In gamma correction, multi-valued voltages generated by a ladder resistance are corrected in order to optimize the voltages output based on the grayscale data. The resistance ratio of resistance circuits of the ladder resistance is determined so that the voltage specified by the manufacturer or the like of the display panel 20 is generated.

2. Signal Driver IC

Figure 2:
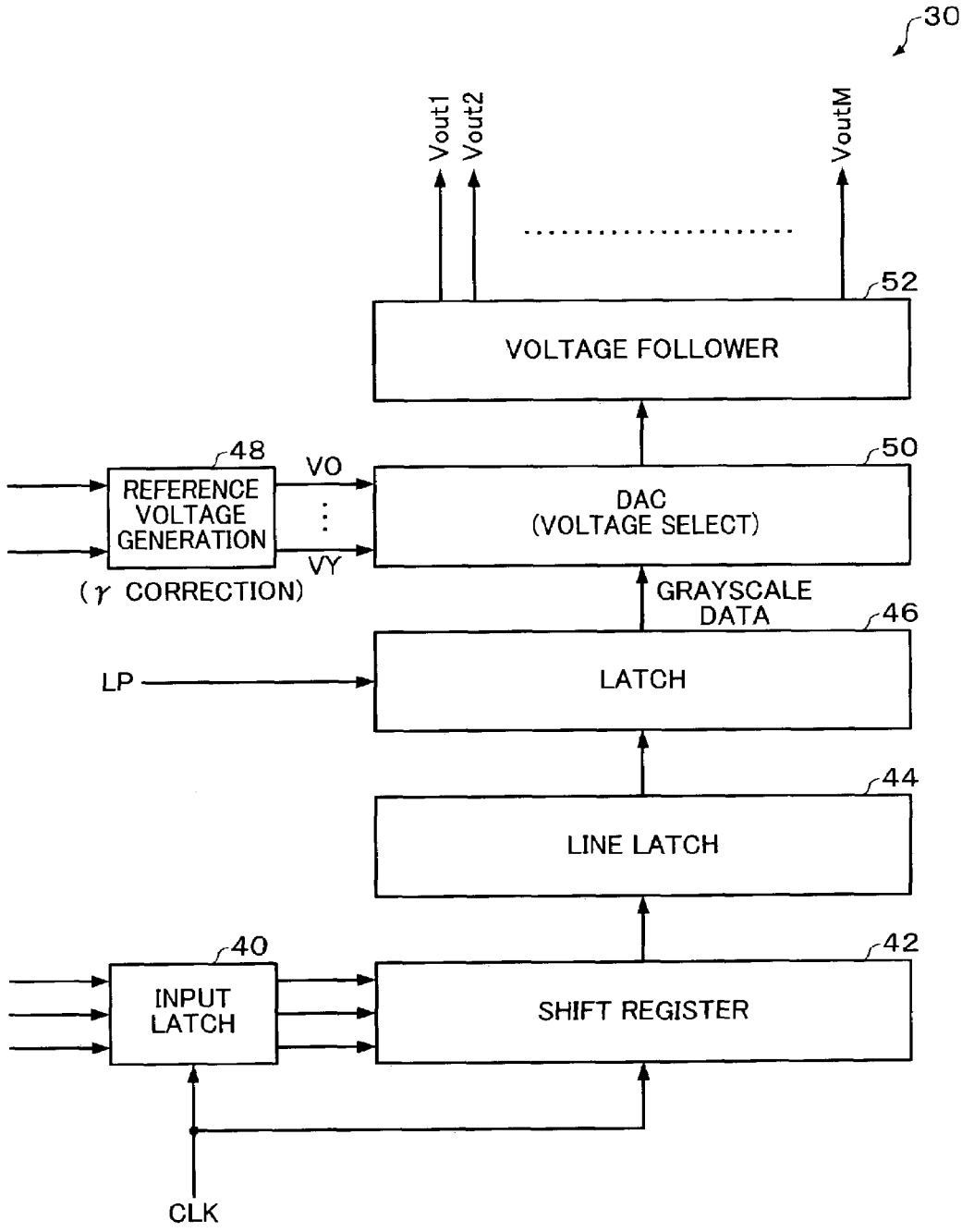
FIG. 2 is a functional block diagram of a signal driver IC to which the display driver circuit including the reference voltage generation circuit is applied.

FIG. 2 is a functional block diagram of the signal driver IC 30 to which the display driver circuit including the reference voltage generation circuit in the present embodiment is applied.

The signal driver IC 30 includes an input latch circuit 40, a shift register 42, a line latch circuit 44, a latch circuit 46, a reference voltage generation circuit (gamma correction circuit in a narrow sense) 48, a DAC (Digital/Analog Converter) (voltage select circuit in a broad sense) 50, and a voltage follower circuit (signal electrode driver circuit in a broad sense) 52.

The input latch circuit 40 latches the grayscale data consisting of each six bits of RGB signals supplied from the signal control circuit 38 shown in FIG. 1 based on a clock signal CLK, for example. The clock signal CLK is supplied from the signal control circuit 38.

The grayscale data latched by the input latch circuit 40 is sequentially shifted based on the clock signal CLK in the shift register 42. The grayscale data sequentially shifted in the shift register 42 is captured in the line latch circuit 44.

The grayscale data captured in the line latch circuit 44 is latched by the latch circuit 46 at a timing of a latch pulse signal LP. The latch pulse signal LP is input in a horizontal scanning cycle.

The reference voltage generation circuit 48 outputs multi-valued reference voltages V0 to VY (Y is an integer) generated in divided nodes which are formed by dividing the ladder resistance circuit by resistance between the power supply voltage (first power supply voltage) V0 on the high potential side and the power supply voltage (second power supply voltage) VSS on the low potential side by using a resistance ratio of the ladder resistance determined so that the grayscale display of the display panel to be driven is optimized.

Figure 3:
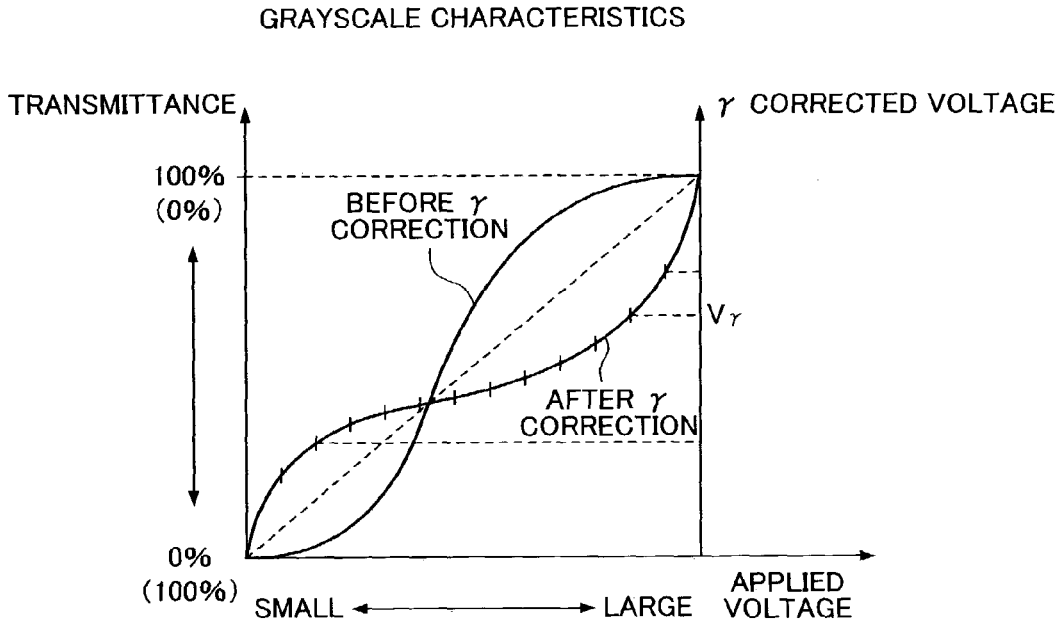
FIG. 3 is an explanatory diagram for describing the principle of gamma correction.

FIG. 3 is a view for describing the principle of gamma correction.

FIG. 3 schematically shows the grayscale characteristics showing a change in transmittance of the pixel with respect to the voltage applied to the liquid crystal. If the transmittance of the pixel is indicated by 0% to 100% (or 100% to 0%), the change in transmittance is generally decreased as the voltage applied to the liquid crystal is decreased or increased. The change in transmittance is increased in a region near the middle of the voltage applied to the liquid crystal.

Therefore, a transmittance gamma-corrected so as to be linearly changed corresponding to the applied voltage can be realized by performing gamma (γ) correction so that the change in transmittance is the reverse of the above-described change in transmittance. Therefore, a reference voltage Vγ which realizes an optimized transmittance can be generated based on the grayscale data as digital data. Specifically, the resistance ratio of the ladder resistance is determined so that such a reference voltage is generated.

The multi-valued reference voltages V0 to VY generated by the reference voltage generation circuit 48 shown in FIG. 2 are supplied to the DAC 50.

The DAC 50 selects one of the multi-valued reference voltages V0 to VY based on the grayscale data supplied from the latch circuit 46, and outputs the selected reference voltage to the voltage follower circuit 52.

The voltage follower circuit 52 transforms the impedance and drives the signal electrode based on the voltage supplied from the DAC 50.

As described above, the signal driver IC 30 transforms the impedance by using the voltage selected from the multi-valued reference voltages based on the grayscale data, and outputs the voltage to each signal electrode.

Figure 4:
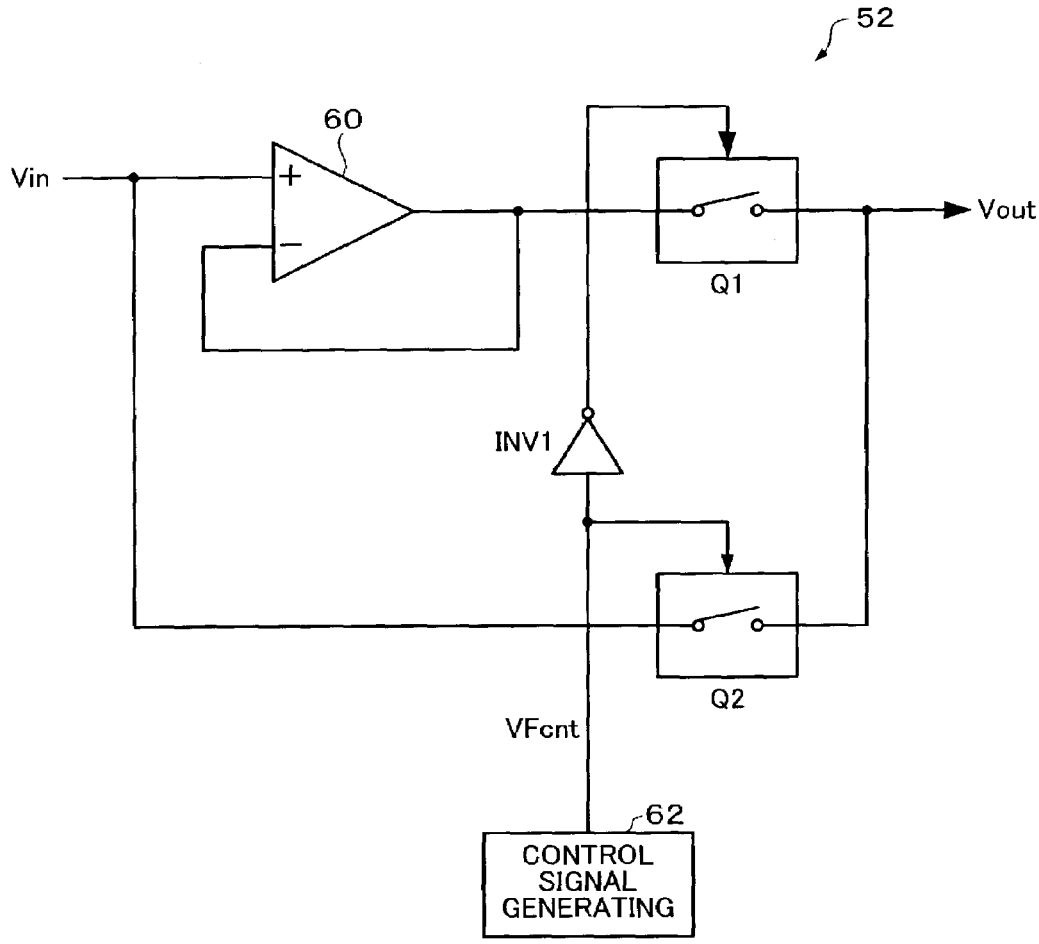
FIG. 4 is a block diagram showing an outline of a configuration of a voltage follower circuit.

FIG. 4 shows an outline of a configuration of the voltage follower circuit 52.

FIG. 4 shows only the configuration for one output.

The voltage follower circuit 52 includes an operational amplifier 60 and first and second switch elements Q1 and Q2.

The operational amplifier 60 is voltage follower connected. Specifically, an output terminal of the operational amplifier 60 is connected with an inverting input terminal of the operational amplifier 60, whereby negative feedback is formed.

A reference voltage Vin selected by the DAC 50 shown in FIG. 2 is input to a noninverting input terminal of the operational amplifier 60. The output terminal of the operational amplifier 60 is connected with the signal electrode, to which a drive voltage Vout is output, through the first switch element Q1. The signal electrode is also connected with the noninverting input terminal of the operational amplifier 60 through the second switch element Q2.

A control signal generating circuit 62 generates a control signal VFcnt for ON-OFF controlling the first and second switch elements Q1 and Q2. The control signal generating circuit 62 may be provided for each unit of one or more signal electrodes.

The second switch element Q2 is ON-OFF controlled by the control signal VFcnt. The first switch element Q1 is ON-OFF controlled by an output signal of an inverter circuit INV1 to which the control signal VFcnt is input.

Figure 5:
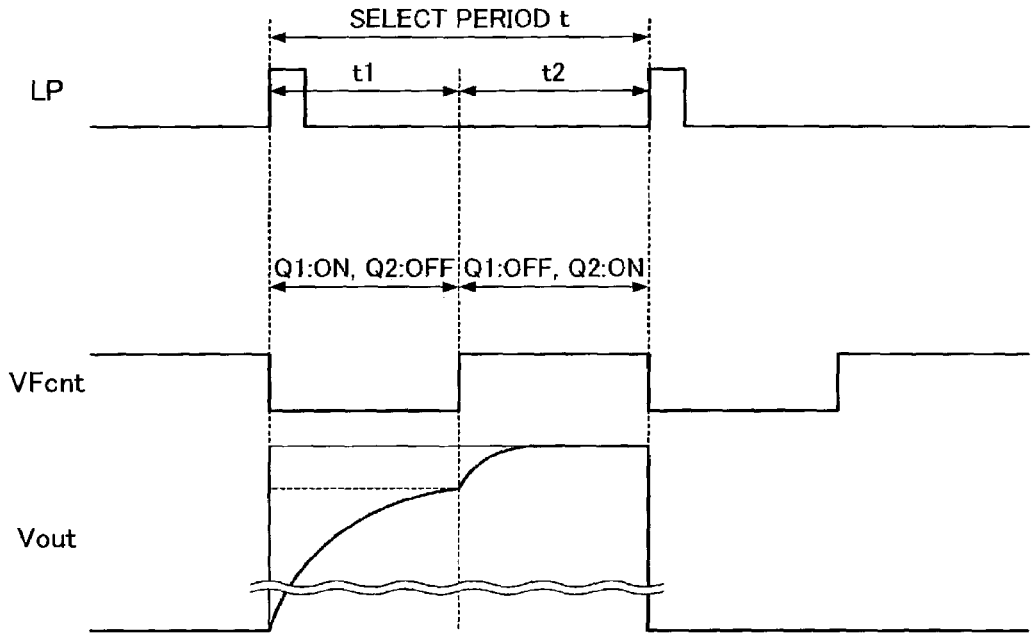
FIG. 5 is a timing chart showing an example of the operation timing of the voltage follower circuit.

FIG. 5 shows an example of the operation timing of the voltage follower circuit 52.

The logic level of the control signal VFcnt generated by the control signal generating circuit 62 is changed between a first period (given first period of drive period) t1 and a second period t2 of a select period (drive period) t specified by the latch pulse signal LP. Specifically, when the logic level of the control signal VFcnt becomes "L" in the first period t1, the first switch element Q1 is turned ON and the second switch element Q2 is turned OFF. When the logic level of the control signal VFcnt becomes "H" in the second period t2, the first switch element Q1 is turned OFF and the second switch element Q2 is turned ON. Therefore, in the first period t1 of the select period t, the signal electrode is driven after impedance transformation by the voltage follower connected operational amplifier 60. In the second period t2, the signal electrode is driven by using the reference voltage output from the DAC 50.

This enables the drive voltage Vout to be raised at high speed by the voltage follower connected operational amplifier 60 having high drive capability in the first period t1 necessary for charging the liquid crystal capacitance, interconnect capacitance, and the like, and the drive voltage to be output by the DAC 50 in the second period t2 in which high drive capability is unnecessary. Therefore, the operation period of the operational amplifier 60 which consumes a large amount of current can be minimized, whereby power consumption can be decreased. Moreover, occurrence of a problem in which the charge period becomes insufficient due to a decrease in the select period t accompanied by an increase in the number of lines can be prevented.

The reference voltage generation circuit 48 is described below in detail.

3. Reference Voltage Generation Circuit

Figure 6:
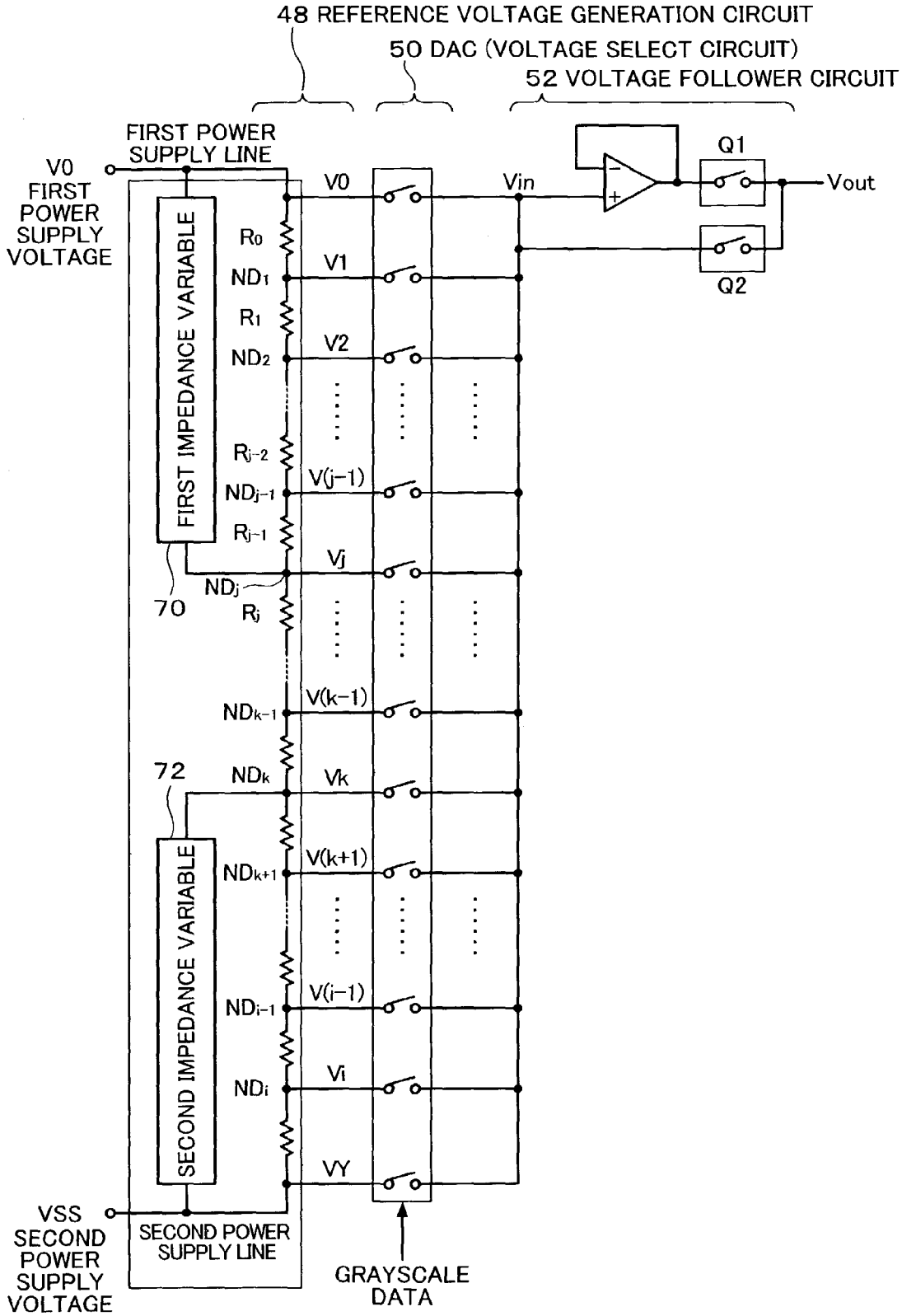
FIG. 6 is a circuit configuration diagram showing an outline of a configuration of the reference voltage generation circuit in the embodiment of the present invention.

FIG. 6 shows an outline of a configuration of the reference voltage generation circuit 48 in the present embodiment.

In FIG. 6, the DAC 50 and the voltage follower circuit 52 are illustrated in addition to the reference voltage generation circuit 48 in the present embodiment.

The reference voltage generation circuit 48 outputs the multi-valued reference voltages V0 to VY by a ladder resistance circuit connected between the first power supply line to which the power supply voltage (first power supply voltage) V0 on the high potential side is supplied and the second power supply line to which the power supply voltage (second power supply voltage) VSS on the low potential side is supplied. The ladder resistance circuit is formed by connecting a plurality of resistance circuits in series. Each of the resistance circuits may be formed by a switch element or a resistance circuit, for example. The voltages of the divided nodes $ND_1$ to $ND_i$ (i is an integer of two or more) which are divided by the resistance of each resistance circuit in the ladder resistance circuit are output to first to ith reference voltage output nodes as the first to ith multi-valued reference voltages V1 to Vi. The first to ith reference voltages V1 to Vi and the reference voltages V0 and VY (=VSS) are supplied to the DAC 50.

The reference voltage generation circuit 48 includes first and second impedance variable circuits 70 and 72. The first impedance variable circuit 70 is capable of changing a first impedance value (resistance value) between the first power supply line and the jth (j is an integer) divided node $ND_j$. The second impedance variable circuit 72 is capable of changing a second impedance value (resistance value) between the kth ($1 \leqq j < k \leqq i$, k is an integer) divided node $ND_k$ and the second power supply line.

As described above, the reference voltage generation circuit 48 changes the impedance between the first power supply line and the jth divided node $ND_j$ and the impedance between the second power supply line and the kth divided node $ND_k$ among the first to ith divided nodes $ND_1$ to $ND_i$ divided by the resistance of each resistance circuit of the ladder resistance circuit connected between the first and second power supply lines. Therefore, the impedance between the jth divided node $ND_j$ and the (k−1)th divided node $ND_{k-1}$ can be fixed.

The multi-valued reference voltages V0 to VY generated by the reference voltage generation circuit 48 are supplied to the DAC 50. The DAC 50 includes switching circuits provided for each reference voltage output node. Each end of the switching circuit can be electrically connected or disconnected by ON-OFF control. Each switching circuit is controlled so that the switching circuits are alternatively turned ON based on the grayscale data supplied from the latch circuit 46 shown in FIG. 2. The DAC 50 outputs the selected voltage to the voltage follower circuit 52 as the output voltage Vin.

3.1 Ladder Resistance

Figure 7:
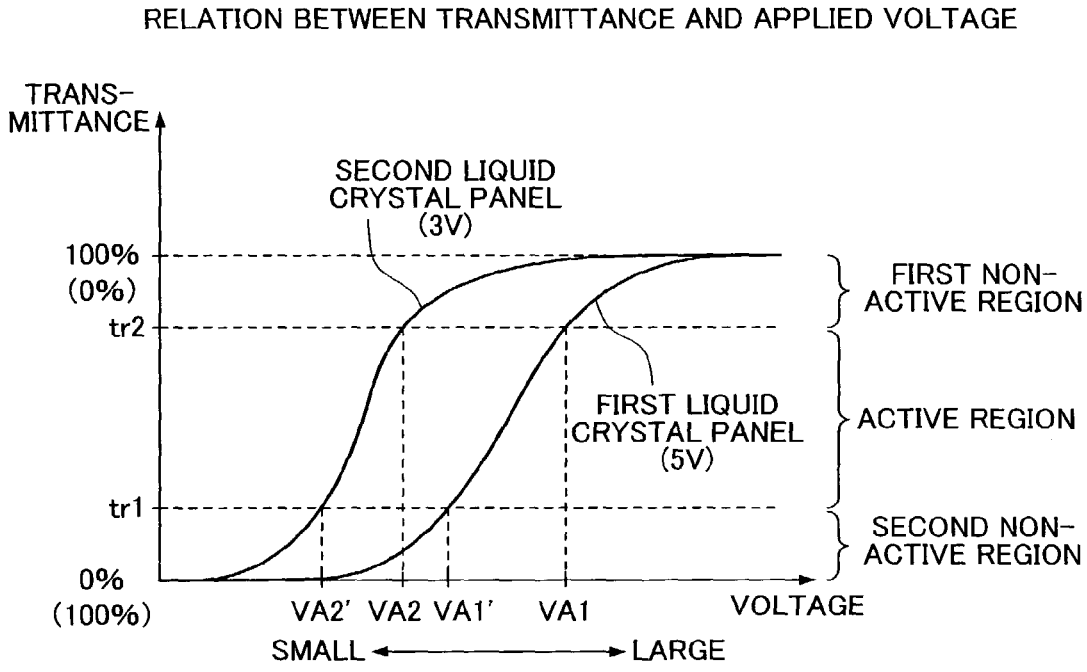
FIG. 7 is an explanatory diagram schematically showing grayscale characteristics.

FIG. 7 schematically shows a characteristic diagram showing grayscale characteristics for describing the resistance ratio of the ladder resistance.

Generally, grayscale characteristics of a display panel, in particular a liquid crystal panel, differ depending on the structure or a liquid crystal material. Therefore, it is known that the relation between the voltage which should be applied to the liquid crystal and the transmittance of the pixel does not become uniform. Taking a first liquid crystal panel with a power supply voltage of 5 V and a second liquid crystal panel with a power supply voltage of 3 V as examples, the range of the applied voltage at which the liquid crystal is operated in an active region in which the change in transmittance of the pixel is large differs between the first and second liquid crystal panels, as shown in FIG. 7. Therefore, it is necessary to determine the resistance ratio of the ladder resistance (ladder resistance circuit) separately for the first and second liquid crystal panels in order to correct the voltage so that optimum grayscale display is realized. The resistance ratio of the ladder resistance used herein refers to a ratio of the resistance value of each resistance circuit of the ladder resistance to the total resistance value of the ladder resistance connected in series between the first and second power supply lines.

As shown in FIG. 7, the resistance ratio of the ladder resistance is set at a small value in a half tone region in which the change in transmittance is large with respect to the change in a voltage applied to the liquid crystal so that the change in a voltage is decreased with respect to the change in one grayscale. The resistance ratio of the ladder resistance is set at a large value in a region in which the change in transmittance is small with respect to the change in a voltage applied to the liquid crystal so that the change in a voltage is increased with respect to the change in one grayscale.

Figure 8:
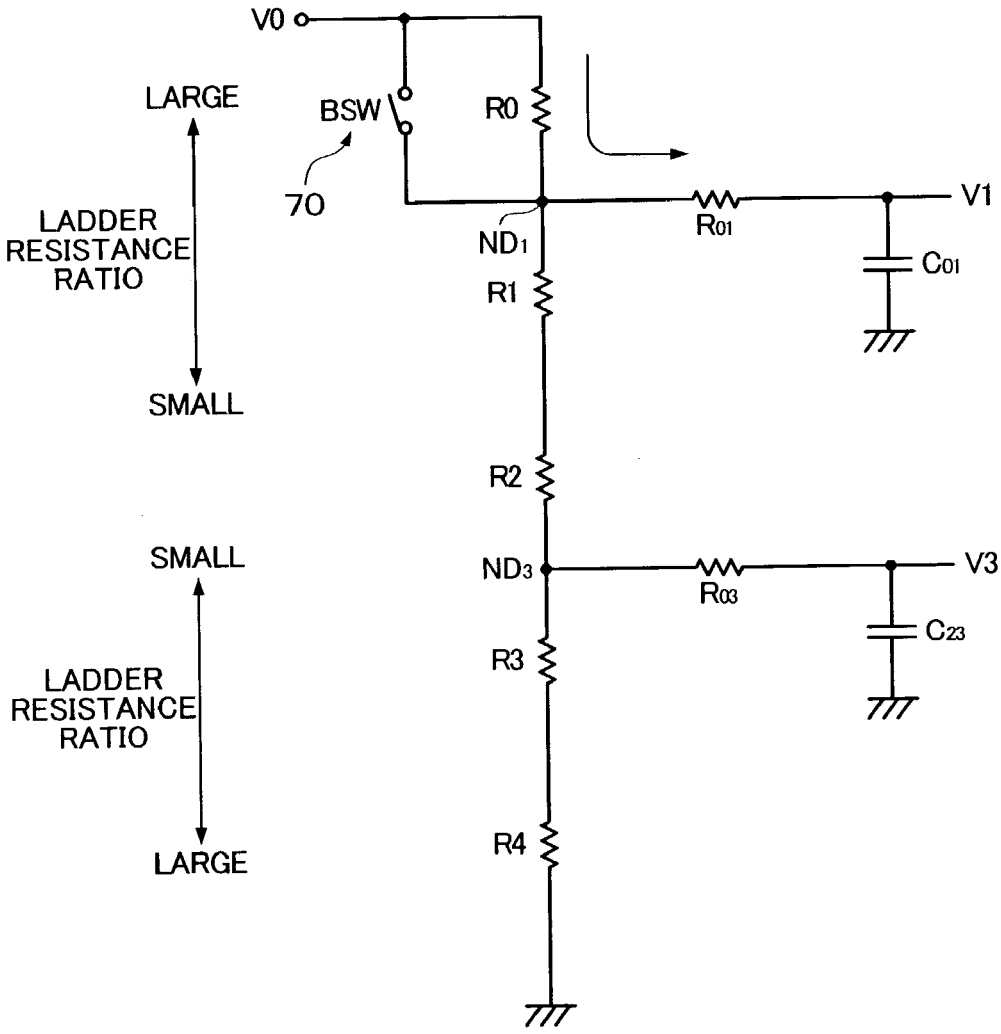
FIG. 8 is an explanatory diagram for schematically describing the operation of the reference voltage generation circuit.

FIG. 8 is a schematic view for describing the operation of the reference voltage generation circuit 48 in which the resistance ratio of the ladder resistance is taken into consideration.

In this example, the ladder resistance circuit consists of resistance circuits R0 to R4 which are connected in series, and the first impedance variable circuit 70 has a switch element BSW inserted between the first divided node $ND_1$ and the first power supply line. Specifically, the first impedance variable circuit 70 decreases the impedance between the first power supply line and the first divided node $ND_1$ by allowing the switch element BSW to be turned ON. The second impedance variable circuit 72 is omitted in FIG. 8.

The divided nodes which are formed by dividing the ladder resistance circuit by the resistance of each resistance circuit of the ladder resistance circuit are connected with the reference voltage output nodes through the switching circuits which make up the DAC as the voltage select circuit.

In this ladder resistance circuit, the resistance values of the resistance circuits R0 and R4 are set larger, and the resistance value of the resistance circuit R2 for generating the reference voltage for a half tone is set smaller than the resistance values of the resistance circuits R0 and R4 according to the grayscale characteristics shown in FIG. 7.

A voltage of the first divided node $ND_1$ reaches the reference voltage V1 in a charge time dependent on a time constant determined by the resistance circuit R0 and a load capacitance $C_{01}$ and an interconnect resistance $R_{01}$ of the node, for example. Therefore, the charge time is increased since the resistance circuit R0 has a large resistance value. In particular, the charge time becomes insufficient in the case where the polarity of the reference voltage to be generated is inverted in a polarity inversion cycle by using a polarity inversion driving method in which the polarity of the voltage applied to the liquid crystal is inverted.

A voltage of the third divided node $ND_3$ reaches the reference voltage V3 in a charge time dependent on a time constant determined by the resistance circuits R0 to R2 and a load capacitance $C_{23}$ and an interconnect resistance $R_{03}$ of the node, for example. Specifically, the impedance is increased by the resistance circuits R0 to R2 and the like even though the resistance value of the resistance circuit R2 for generating the reference voltage near the half tone is small. This results in an increase in the charge time.

The time constant of each divided node can be decreased by decreasing the resistance value of each resistance circuit of the ladder resistance. However, this increases the amount of current flowing through the ladder resistance, whereby power consumption is increased. Therefore, it is preferable that the resistance values of the resistance circuits of the ladder resistance be large from the viewpoint of a decrease in power consumption.

In the present embodiment, the resistance values of the resistance circuits of the ladder resistance are increased and the charge time is decreased by decreasing the impedance from the power supply when charging is necessary by providing the switching circuit BSW as the first impedance variable circuit 70 so that the ladder resistance circuit R0 is bypassed.

Figure 9:
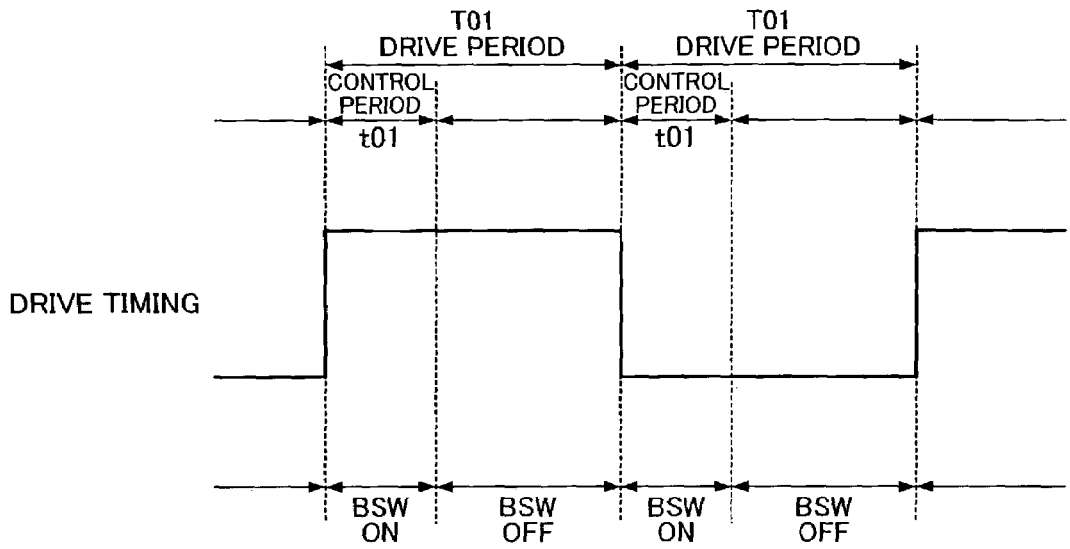
FIG. 9 is a timing chart showing an example of the control timing of a first impedance variable circuit.
Figure 10:
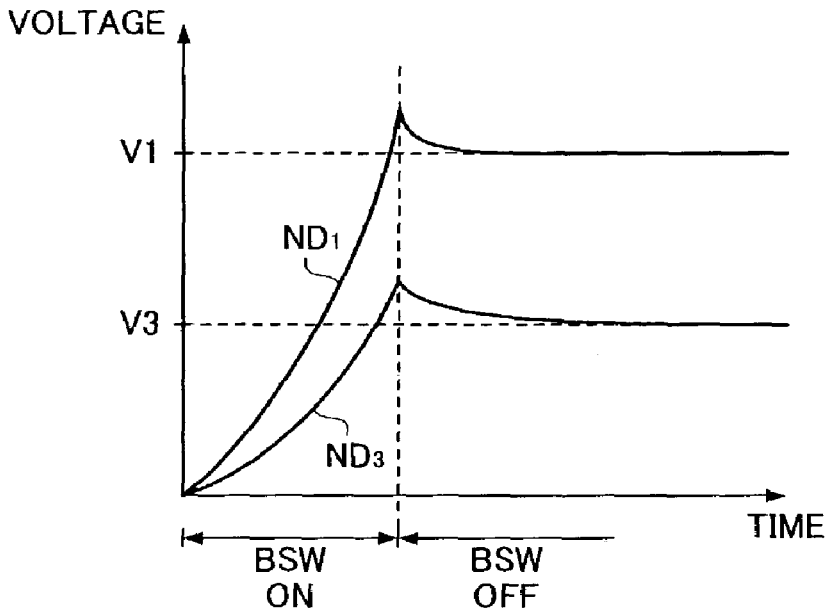
FIG. 10 is an explanatory diagram showing an example of a change in a voltage of a divided node.

FIG. 9 shows an example of the control timing of the first impedance variable circuit 70. FIG. 10 shows an example of the voltages of the first and third divided nodes $ND_1$ and $ND_3$ which are changed according to the control timing shown in FIG. 9.

The first impedance variable circuit 70 can be controlled according to the drive timing corresponding to a polarity inversion signal POL which specifies the polarity inversion cycle in a polarity inversion driving method, for example. Specifically, the resistance circuit R0 is bypassed by allowing the switching circuit BSW as the first impedance variable circuit 70 to be turned ON in a first control period (given control period) t01 of a drive period (given drive period) T01 in which the signal electrode is driven based on the grayscale data. Therefore, since the impedance from the first power supply line can be decreased, the first divided node $ND_1$ rapidly reaches near the given reference voltage V1 (FIG. 10). After the control period t01 has elapsed, the first divided node $ND_1$ is set at the reference voltage V1 divided by resistance by allowing the switching circuit BSW to be turned OFF (FIG. 10). This also applies to the third divided node $ND_3$.

3.2 Application Example to Signal Driver IC

Figure 11:
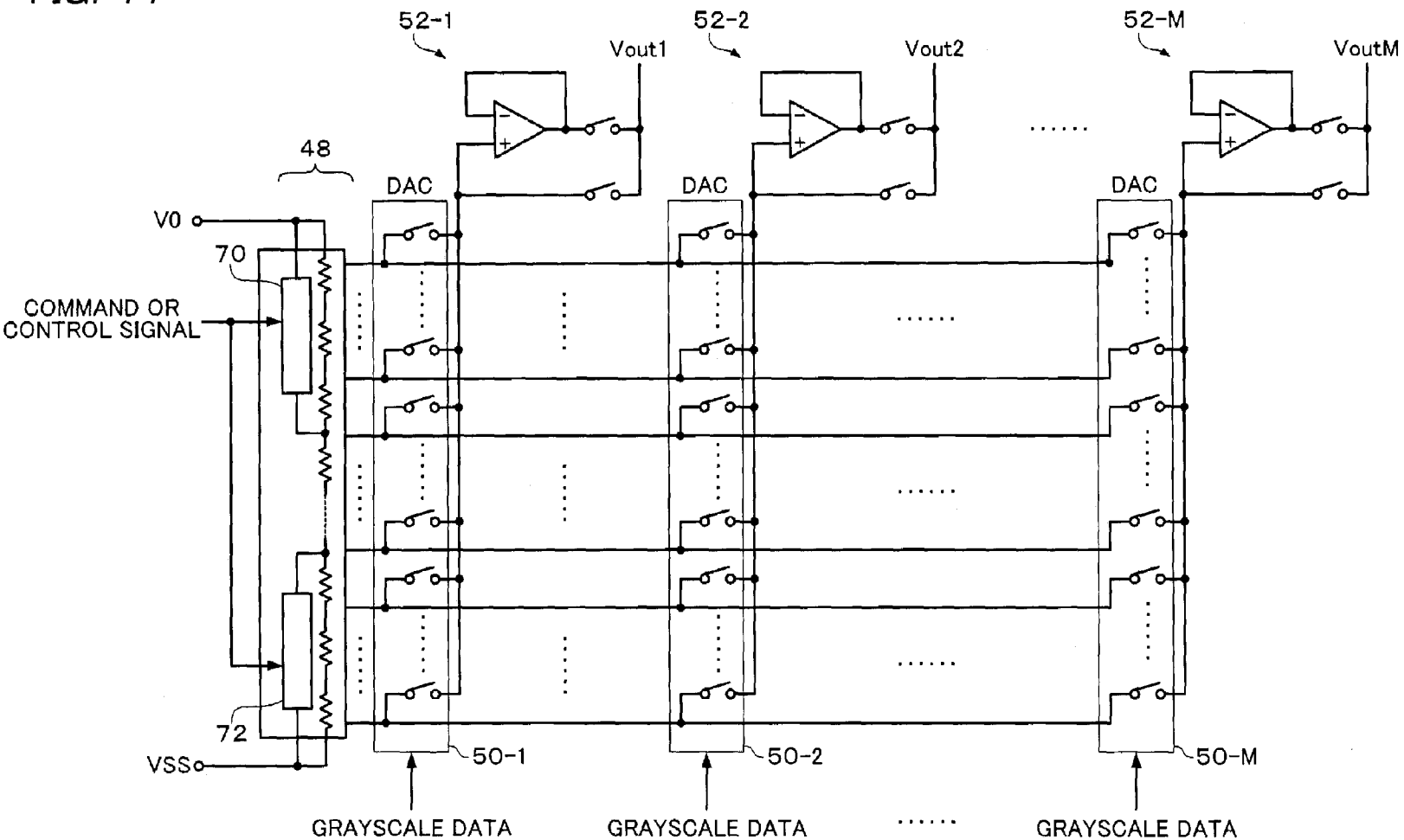
FIG. 11 is a configuration diagram showing an example of a specific configuration of the signal driver IC to which the reference voltage generation circuit is applied.

FIG. 11 shows an example of a specific configuration of the signal driver IC 30 to which the reference voltage generation circuit 48 is applied.

FIG. 11 shows a case where the reference voltage generation circuit 48 is shared to drive M signal electrodes. Specifically, the DACs 50-1 to 50-M and the voltage follower circuits 52-1 to 52-M are provided for each of the M signal electrodes $S_1$ to $S_M$.

The DACs 50-1 to 50-M select one of the multi-valued reference voltages based on the grayscale data corresponding to each signal electrode. The multi-valued reference voltages supplied to the DACs 50-1 to 50-M are generated by the reference voltage generation circuit 48. The reference voltage generation circuit 48 includes the ladder resistance circuit and the first and second impedance variable circuits 70 and 72. The first and second impedance variable circuits 70 and 72 variably control the impedance between the first or second power supply line and given divided nodes which are formed by dividing the ladder resistance circuit by the resistance circuits according to a given variable control signal. This configuration makes the effect of preventing an increase in circuit scale by the reference voltage generation circuit 48 significant even if the number of signal electrodes is increased.

3.3 Configuration of Impedance Variable Circuit

The first and second impedance variable circuits 70 and 72 which are variably controlled as described above in the reference voltage generation circuit 48 may have the following configuration.

3.3.1 First Configuration Example

Figure 12:
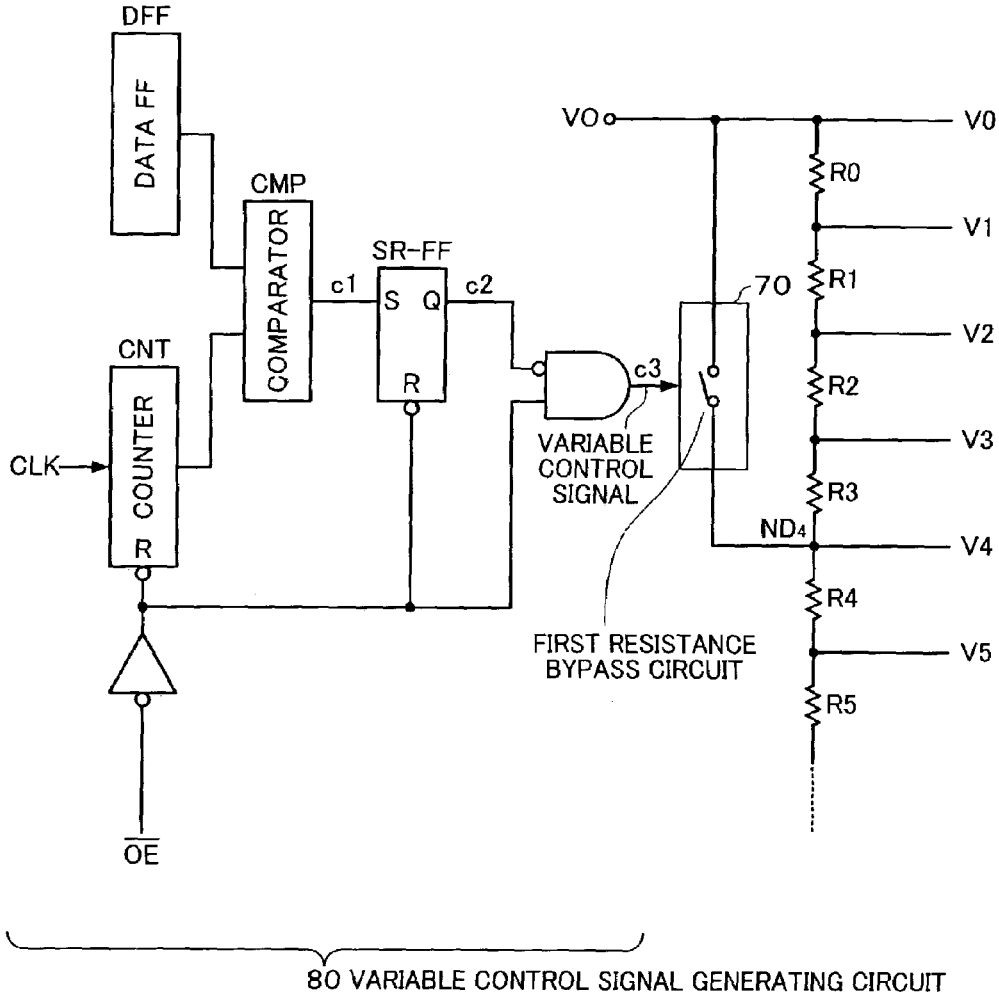
FIG. 12 is a configuration diagram showing a first configuration example of the first impedance variable circuit.

FIG. 12 shows a first configuration example of the first impedance variable circuit 70.

In this example, the first impedance variable circuit 70 changes a first impedance value which is the impedance between the jth (j is an integer) divided node NDj and the first power supply line in the ladder resistance circuit which outputs the voltages of the first to ith (i is an integer of two or more) divided nodes $ND_1$ to $ND_i$ divided by the resistance of each resistance circuit as the first to ith reference voltages V1 to Vi.

In the case where the first impedance variable circuit 70 is inserted between the first power supply line and the fourth divided node $ND_4$, the first impedance variable circuit 70 is ON-OFF controlled by a variable control signal c3 generated by a variable control signal generating circuit 80 as shown in FIG. 12, for example.

Figure 13:
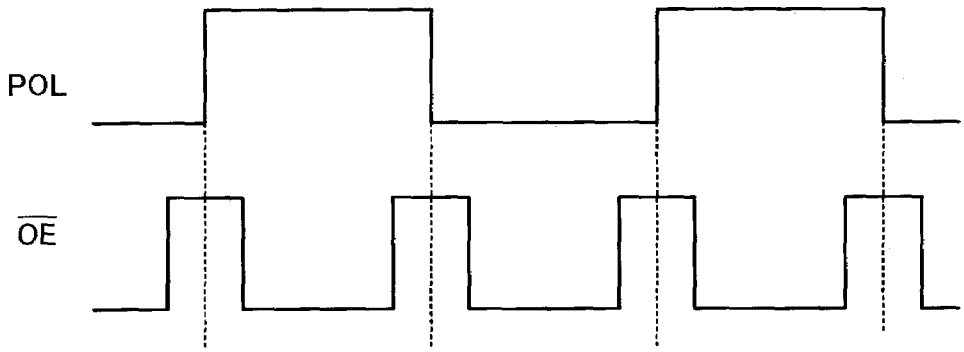
FIG. 13 is an explanatory diagram for describing an output enable signal.

The variable control signal generating circuit 80 includes a counter CNT, a data flip-flop DFF, a comparator CMP, and a set-reset flip-flop SR-FF. A clock count value of the clock signal CLK corresponding to the control period t01 shown in FIG. 9 is set at the data flip-flop DFF in advance. The counter CNT counts up by one based on the clock signal CLK. The comparator CMP detects coincidence between the clock count value set at the data flip-flop DFF and the count value counted up by the counter CNT, and outputs a comparative result signal c1 which becomes a logic level "H" when the clock count value coincide with the count value. The set-reset flip-flop is set by the comparative result signal c1, and reset based on a given output enable signal XOE. The counter CNT is also reset based on the output enable signal XOE. The output enable signal XOE becomes a logic level "H" for only a given period before and after a leading edge and a falling edge of the polarity inversion signal POL, as shown in FIG. 13. The signal electrode is driven based on the output enable signal XOE. The variable control signal c3 is generated based on a data output signal c2 of the set-reset flip-flop SR-FF and the output enable signal XOE.

Figure 14:
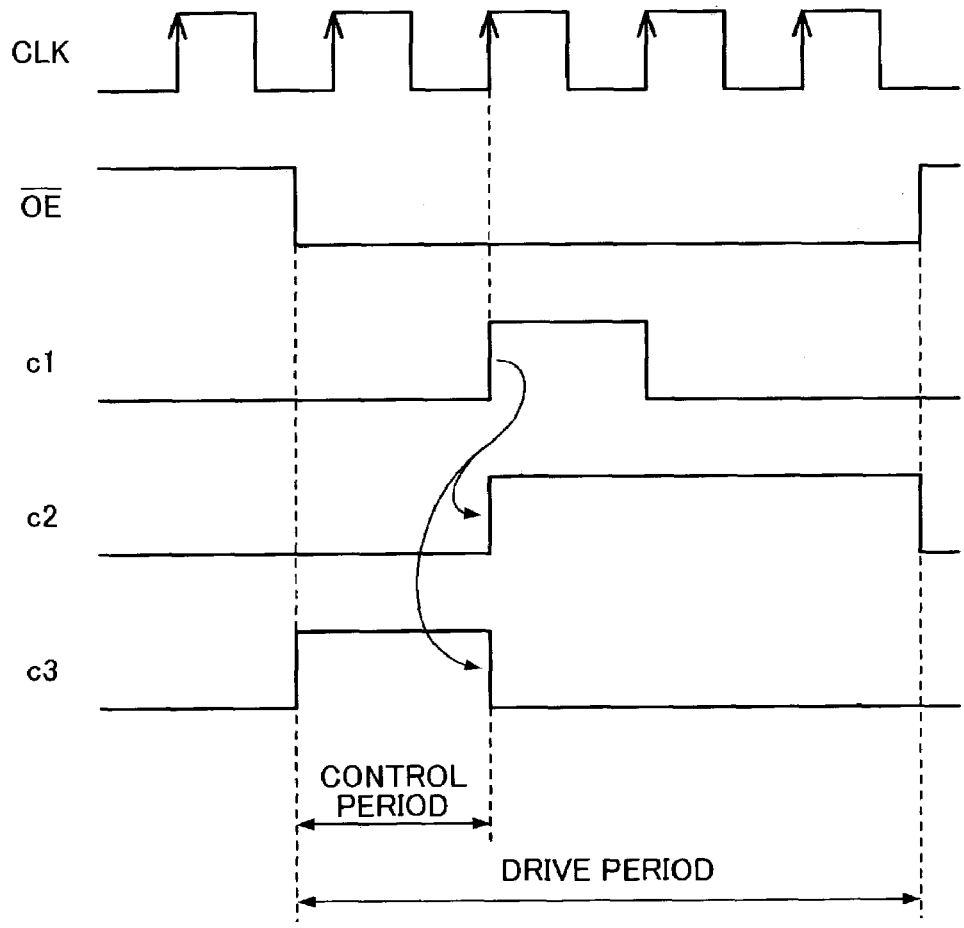
FIG. 14 is a timing chart showing an example of the control timing in the first configuration example.

FIG. 14 shows an example of the control timing of the variable control signal generating circuit 80.

The counter CNT and the set-reset flip-flop SR-FF are reset when the logic level of the output enable signal XOE shown in FIG. 13 is "H". At this time, since the data output signal c2 at a logic level "L" is output and the variable control signal c3 is at a logic level "L", the switching circuit of the first impedance variable circuit 70 is turned OFF.

When the logic level of the output enable signal XOE becomes "L", the switching circuit of the first impedance variable circuit 70 is turned ON, and the counter CNT starts to count up based on the clock signal CLK. In the case where "2" is set at the data flip-flop DFF in advance, the logic level of the comparative result signal c1 becomes "H" at a second clock of the clock signal CLK. When the logic level of the comparative result signal cl becomes "H", the set-reset flip-flop SR-FF is set and the logic level of the variable control signal c3 becomes "L", whereby the switching circuit of the first impedance variable circuit 70 is turned OFF.

As described above, after the logic level of the output enable signal XOE becomes "L", the impedance between the first power supply line and the fourth divided node $ND_4$ is decreased by the first impedance variable circuit 70 for a period of time corresponding to the clock count value set at the data flip-flop DFF. Therefore, the charge time of the fourth divided node $ND_4$ is decreased, and the fourth divided node $ND_4$ then reaches the precise reference voltage V4.

Figure 15:
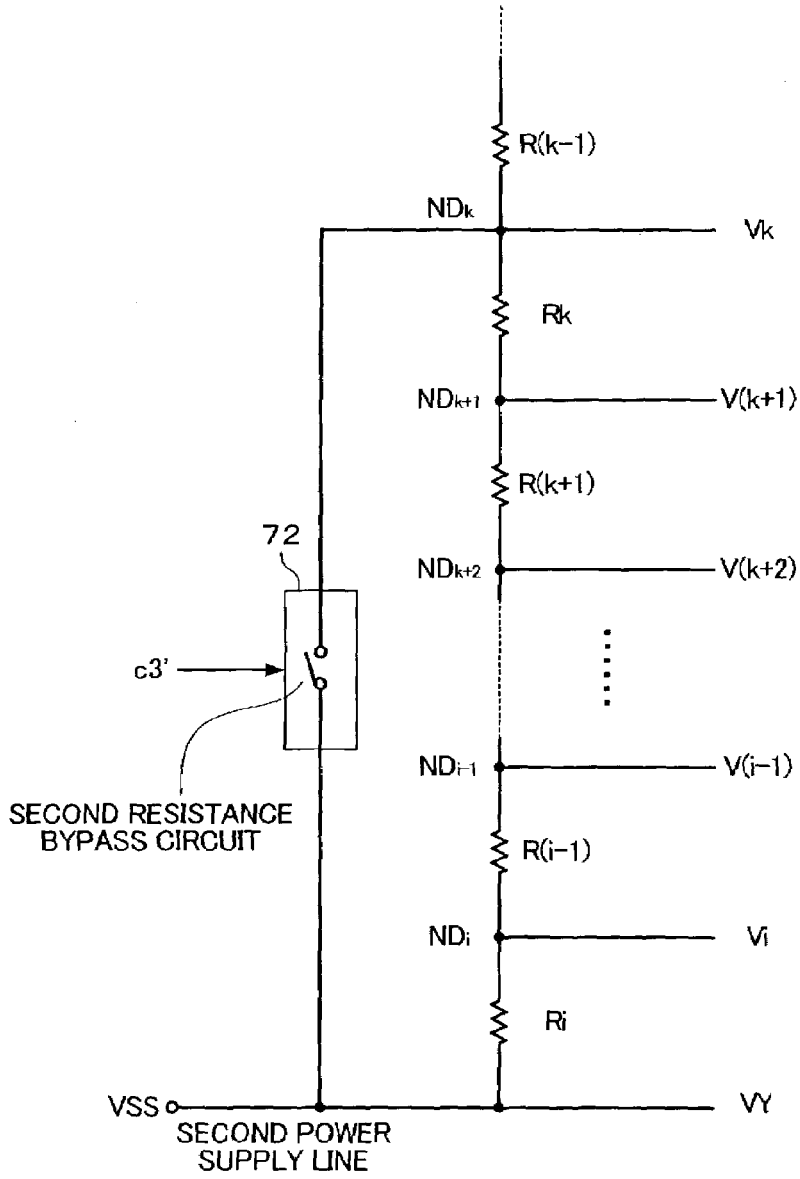
FIG. 15 is a configuration diagram in the case where a second impedance variable circuit is realized in the first configuration example.

The second impedance variable circuit 72 may also have a configuration as shown in FIG. 15. Specifically, the second impedance variable circuit 72 changes the second impedance value which is the impedance between the kth (k is an integer) divided node and the second power supply line in the ladder resistance circuit which outputs the voltages of the first to ith ($j<k\leqq i$, i is an integer of two or more) divided nodes $ND_1$ to $ND_i$ divided by the resistance of each resistance circuit as the first to ith reference voltages V1 to Vi.

The second impedance variable circuit 72 is ON-OFF controlled by a variable control signal c3'. As the variable control signal c3', a signal equal to the variable control signal c3 may be used.

According to the first configuration example, since the impedance from the power supply can be decreased in a period necessary for charging, power consumption can be decreased by increasing the resistance values of the resistance circuits of the ladder resistance circuit. Moreover, a sufficient charge time can be secured.

3.3.2 Second Configuration Example

Figure 16:
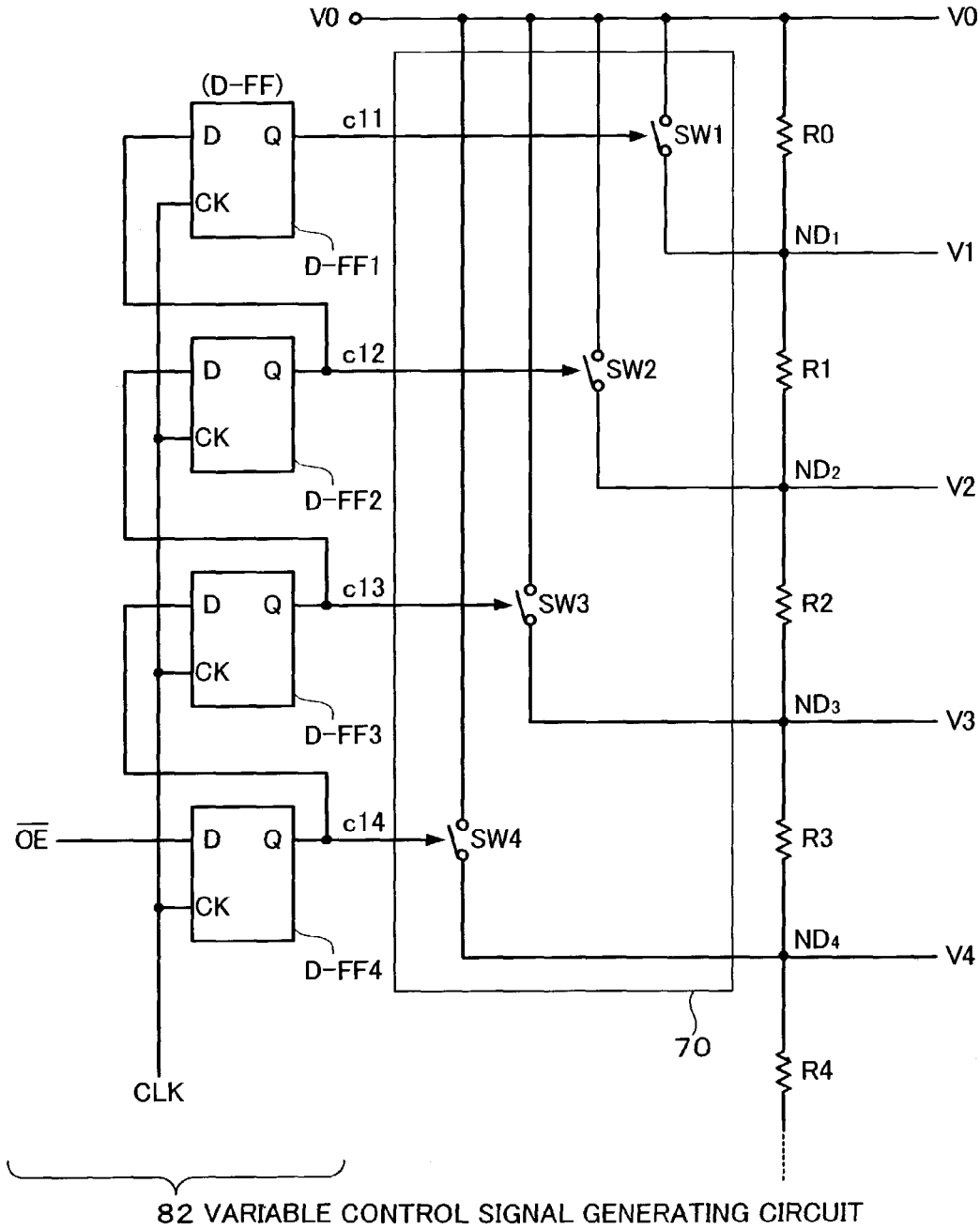
FIG. 16 is a configuration diagram showing a second configuration example of the first impedance variable circuit.

FIG. 16 shows a second configuration example of the first impedance variable circuit 70.

In this example, the first impedance variable circuit 70 includes first to jth switching circuits SW1 to SWj which respectively bypass the first power supply line with the first to jth divided nodes $ND_1$ to $ND_j$, and decreases the impedance between the first power supply line and the first to jth divided nodes $ND_1$ to $ND_j$ in the ladder resistance circuit which outputs the voltages of the first to ith (i is an integer of two or more) divided nodes $ND_1$ to $ND_i$ divided by the resistance of each resistance circuit as the first to ith reference voltages V1 to Vi. FIG. 16 illustrates a case where j is four.

The first impedance variable circuit 70 is ON-OFF controlled by variable control signals c11, c12, c13, and c14 generated by a variable control signal generating circuit 82 as shown in FIG. 16, for example.

The variable control signal generating circuit 82 includes first to fourth data flip-flops (hereinafter abbreviated as "D-FF1 to D-FF4"). D-FF1 to D-FF4 latch a signal input to a data input terminal D based on a signal input to a clock input terminal CK, and output the signal from a data output terminal Q. The clock signal CLK is input in common to the clock input terminals CK of D-FF1 to D-FF4. The output enable signal XOE shown in FIG. 13 is input to the data input terminal D of D-FF4. The variable control signal c14 is output from the data output terminal Q of D-FF4. The variable control signal c14 is input to the first impedance variable circuit 70. The switching circuit SW4 inserted between the first power supply line and the fourth divided node $ND_4$ is ON-OFF controlled by the variable control signal c14. The data output terminal Q of D-FF4 is connected with the data input terminal D of D-FF3.

The variable control signal c13 is output from the data output terminal Q of D-FF3. The variable control signal c13 is input to the first impedance variable circuit 70. The switching circuit SW3 inserted between the first power supply line and the third divided node $ND_3$ is ON-OFF controlled by the variable control signal c13. The data output terminal Q of D-FF3 is connected with the data input terminal D of D-FF2.

The variable control signal c12 is output from the data output terminal Q of D-FF2. The variable control signal c12 is input to the first impedance variable circuit 70. The switching circuit SW2 inserted between the first power supply line and the second divided node $ND_2$ is ON-OFF controlled by the variable control signal c12. The data terminal Q of D-FF2 is connected with the data input terminal D of D-FF1.

The variable control signal c11 is output from the data output terminal Q of D-FF1. The variable control signal c11 is input to the first impedance variable circuit 70. The switching circuit SW1 inserted between the first power supply line and the first divided node $ND_1$ is ON-OFF controlled by the variable control signal c11.

Figure 17:
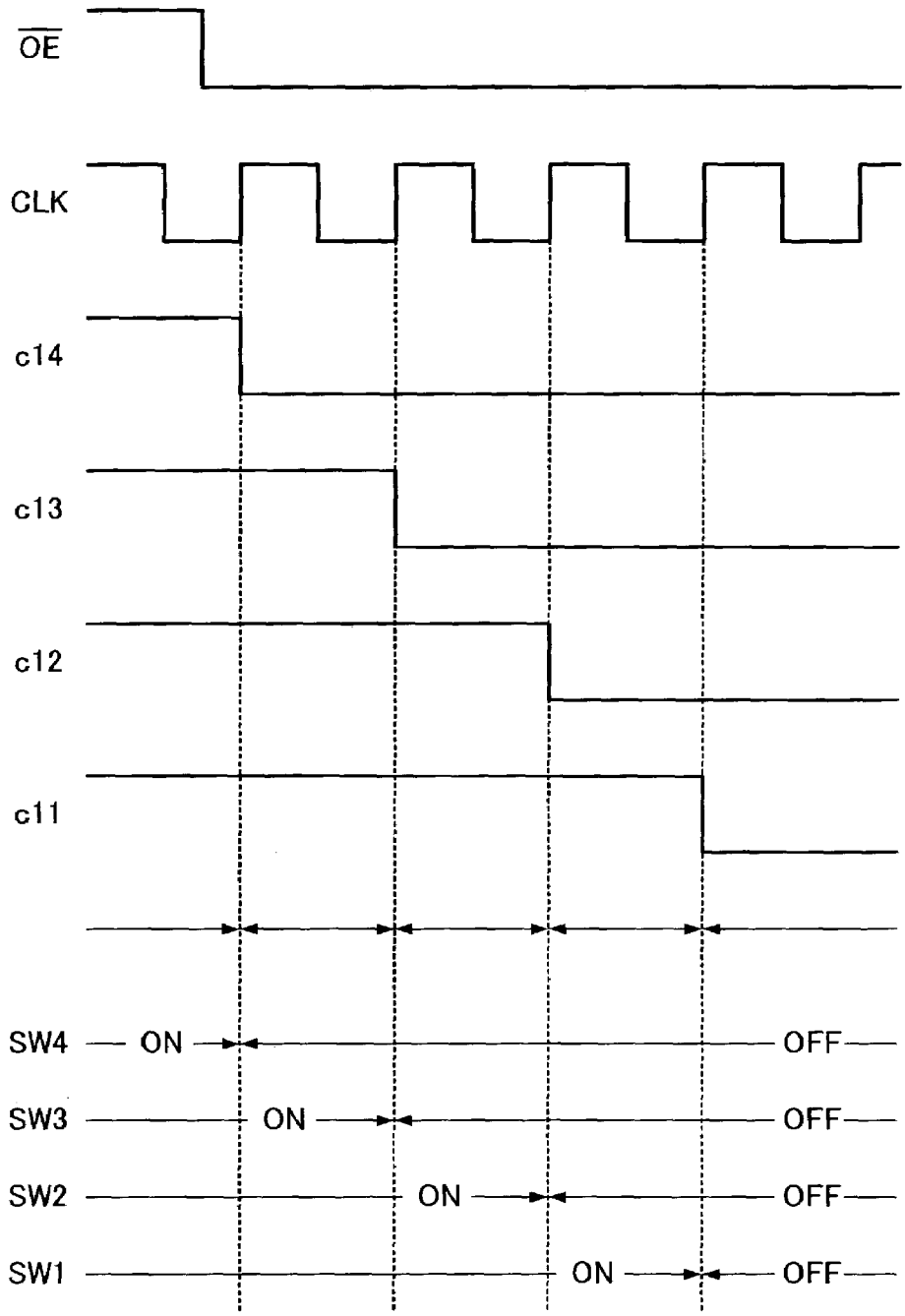
FIG. 17 is a timing chart showing an example of the control timing in the second configuration example.

FIG. 17 shows an example of the control timing of the variable control signal generating circuit 82.

The output enable signal XOE at a logic level "H" input to D-FF4 as shown in FIG. 13 is sequentially output from the data output terminals Q of D-FF3, D-FF2, and D-FF1 in synchronization with the clock signal CLK. Therefore, the variable control signals c14, c13, c12, and c11 sequentially become a logic level "L" at each clock of the clock signal CLK. As a result, the first to fourth divided nodes $ND_1$ to $ND_4$ are bypassed (electrically connected) with the first power supply line by allowing the switching circuits SW1 to SW4 to be turned ON, and the fourth to first divided nodes $ND_4$ to $ND_1$ are electrically disconnected from the first power supply line by allowing the switching circuits SW4, SW3, SW2, and SW1 to be sequentially turned OFF. Therefore, since the impedance values of the impedance between the first power supply line and the first to fourth divided nodes $ND_1$ to $ND_4$ are returned to the original given values in the order from the divided node of which the voltage level to be reached is smaller, the reference voltages V1 to V4 can be allowed to rapidly reach the target voltages.

Figure 18:
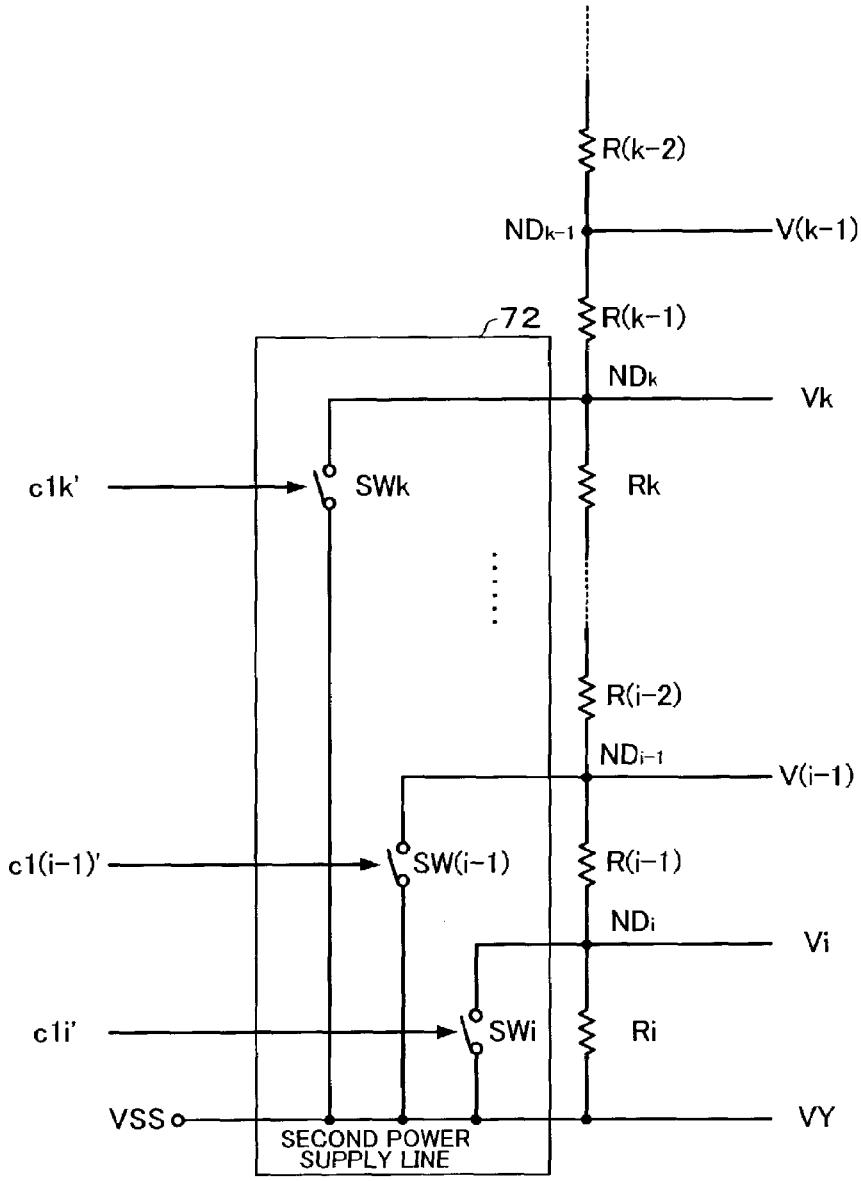
FIG. 18 is a configuration diagram in the case where the second impedance variable circuit is realized in the second configuration example.

The second impedance variable circuit 72 may also have a configuration as shown in FIG. 18. Specifically, the second impedance variable circuit 72 includes kth to ith (i is an integer of two or more) switching circuits SWk to SWi which respectively bypass the second power supply line with the kth to ith divided nodes $ND_k$ to $ND_i$, and decreases the impedance between the second power supply line and the kth to ith divided nodes $ND_k$ to $ND_i$ in the ladder resistance circuit which outputs the voltages of the first to ith divided nodes $ND_1$ to $ND_i$ divided by the resistance of each resistance circuit as the first to ith reference voltages V1 to Vi. Each switching circuit is ON-OFF controlled by variable control signals c1k', . . . , c1 (i−1)', and c1*i*'. The variable control signals may be shared with the variable control signals of the first impedance variable circuit 70. In this case, the kth to ith divided nodes $ND_k$ to $ND_i$ are sequentially disconnected electrically from the second power supply line by allowing all the kth to ith switching circuits SWk to SWi to be turned ON and then allowing the switching circuits to be sequentially turned OFF in the same manner as described above.

According to the second configuration example, since the impedance from the power supply can be decreased in a period necessary for charging, power consumption can be decreased by increasing the resistance values of the resistance circuits of the ladder resistance circuit. Moreover, a sufficient charge time can be secured.

3.3.3 Third Configuration Example

In the first and second configuration examples, a decrease in the charge time is achieved by decreasing the impedance from the power supply by short-circuiting the power supply line and the divided node. However, the present invention is not limited thereto. For example, the impedance from the power supply may be decreased by decreasing the resistance value of the ladder resistance between the power supply line and the divided node.

Specifically, the ladder resistance circuit includes a plurality of resistance circuits connected in series between the first and second power supply lines to which first and second power supply voltages are supplied, and outputs the voltages of the first to ith (i is an integer of two or more) divided nodes $ND_1$ to $ND_i$ divided by the resistance of each resistance circuit as the first to ith reference voltages V1 to Vi. The impedance of the resistance circuit connected between the first power supply line and the jth (j is an integer) divided node is changed by a first switching circuit group. The impedance of the resistance circuit connected between the second power supply line and the kth ($1 \leqq j < k \leqq i$, k is an integer) divided node is changed by a second switching circuit group. In more detail, the first and second switching circuit groups decrease the impedance of the resistance circuits in a given control period of the drive period, and increase the impedance of the resistance circuits after the control period has elapsed.

The first and second switching circuit groups may be connected either in series or in parallel with the resistance circuits of the ladder resistance circuit.

This also enables the impedance from the power supply to be decreased in a period necessary for charging and the resistance values of the resistance circuits of the ladder resistance circuit to be increased, whereby power consumption can be decreased.

Figure 19C:
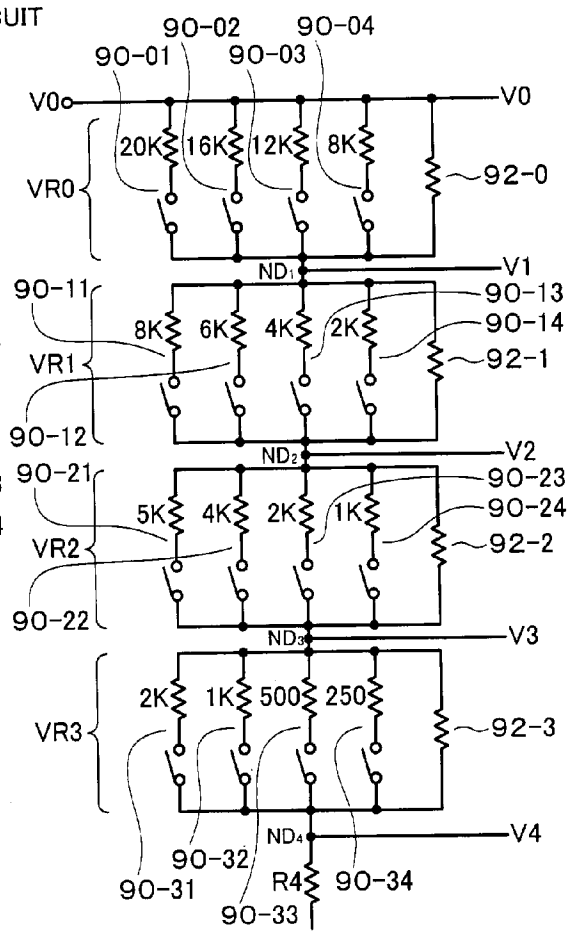
FIGS. 19A to 19C are circuit configuration diagrams of a first ladder resistance circuit in a third configuration example.
Figure 19B:
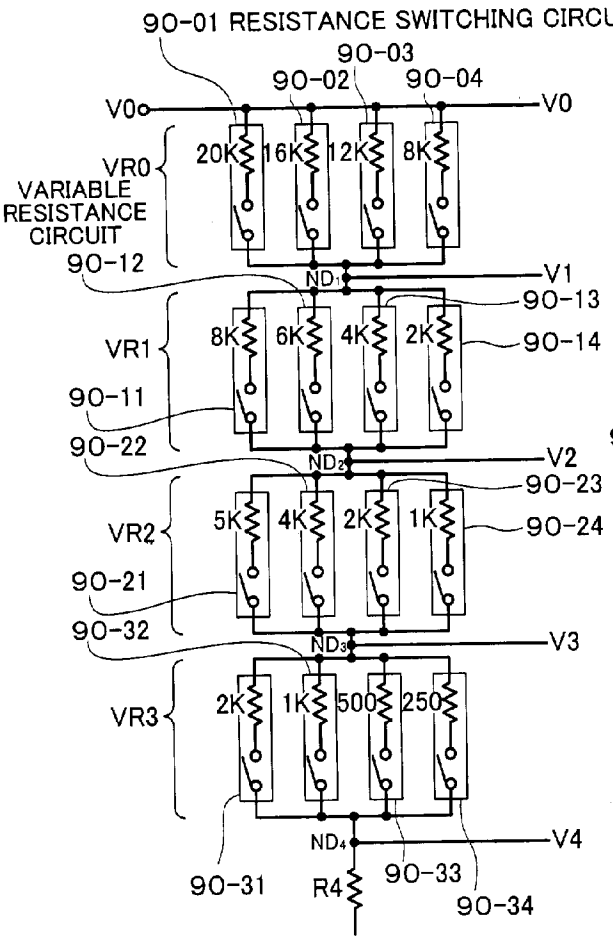
Figure 19A:
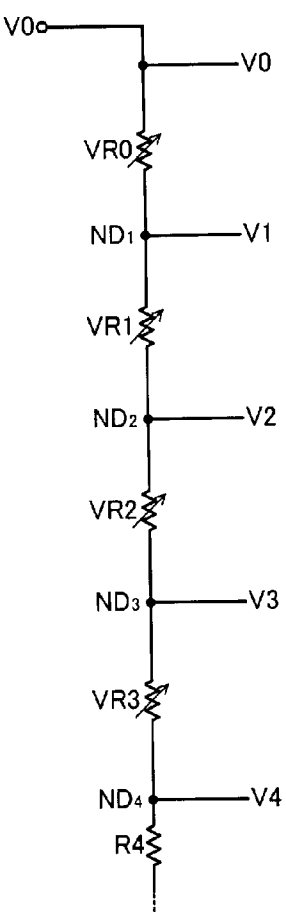

FIGS. 19A to 19C show a third configuration example of the ladder resistance circuit.

Specifically, the ladder resistance circuit includes variable resistance circuits VR0 to VR3 connected in series, for example, as shown in FIG. 19A. As shown in FIG. 19B, the variable resistance circuit may be formed by parallelly connecting resistance switching circuits in which a switching circuit (switch element) and a resistance circuit (resistance element) are connected in series. In this case, the resistance switching circuits connected in parallel are controlled so that at least one of the switching circuits is turned ON based on a given variable control signal.

For example, the variable resistance circuit VR0 may be formed by connecting resistance switching circuits 90-01 to 90-04 in parallel. The variable resistance circuit VR1 may be formed by connecting resistance switching circuits 90-11 to 90-14 in parallel. The variable resistance circuit VR2 may be formed by connecting resistance switching circuits 90-21 to 90-24 in parallel. The variable resistance circuit VR3 may be formed by connecting resistance switching circuits 90-31 to 90-34 in parallel.

As shown in FIG. 19C, a resistance circuit may be further connected in parallel with the resistance switching circuits which are connected in parallel in the variable resistance circuit.

For example, the variable resistance circuit VR0 may be formed by connecting a resistance circuit 92-0 in parallel with the resistance switching circuits 90-01 to 90-04. The variable resistance circuit VR1 may be formed by connecting a resistance circuit 92-1 in parallel with the resistance switching circuits 90-11 to 90-14. The variable resistance circuit VR2 may be formed by connecting a resistance circuit 92-2 in parallel with the resistance switching circuits 90-21 to 90-24. The variable resistance circuit VR3 may be formed by connecting a resistance circuit 92-3 in parallel with the resistance switching circuits 90-31 to 90-34.

In this case, it is unnecessary to control the resistance switching circuits connected in parallel so that at least one of the switching circuits is turned ON. This eliminates the need to avoid a state in which the switching circuits are erroneously opened, or to provide a circuit for avoiding such a state, whereby the configuration or control is simplified.

The switching circuit of each resistance switching circuit is ON-OFF controlled based on a given variable control signal. Therefore, the impedance between the divided node and the power supply line can be decreased by variably controlling the resistance value of each variable resistance circuit between the first power supply line and the jth divided node, or variably controlling the resistance value of each resistance circuit between the second power supply line and the kth divided node. Therefore, effects the same as in the above-described configuration examples can be obtained.

3.3.4 Fourth Configuration Example

Figure 20:
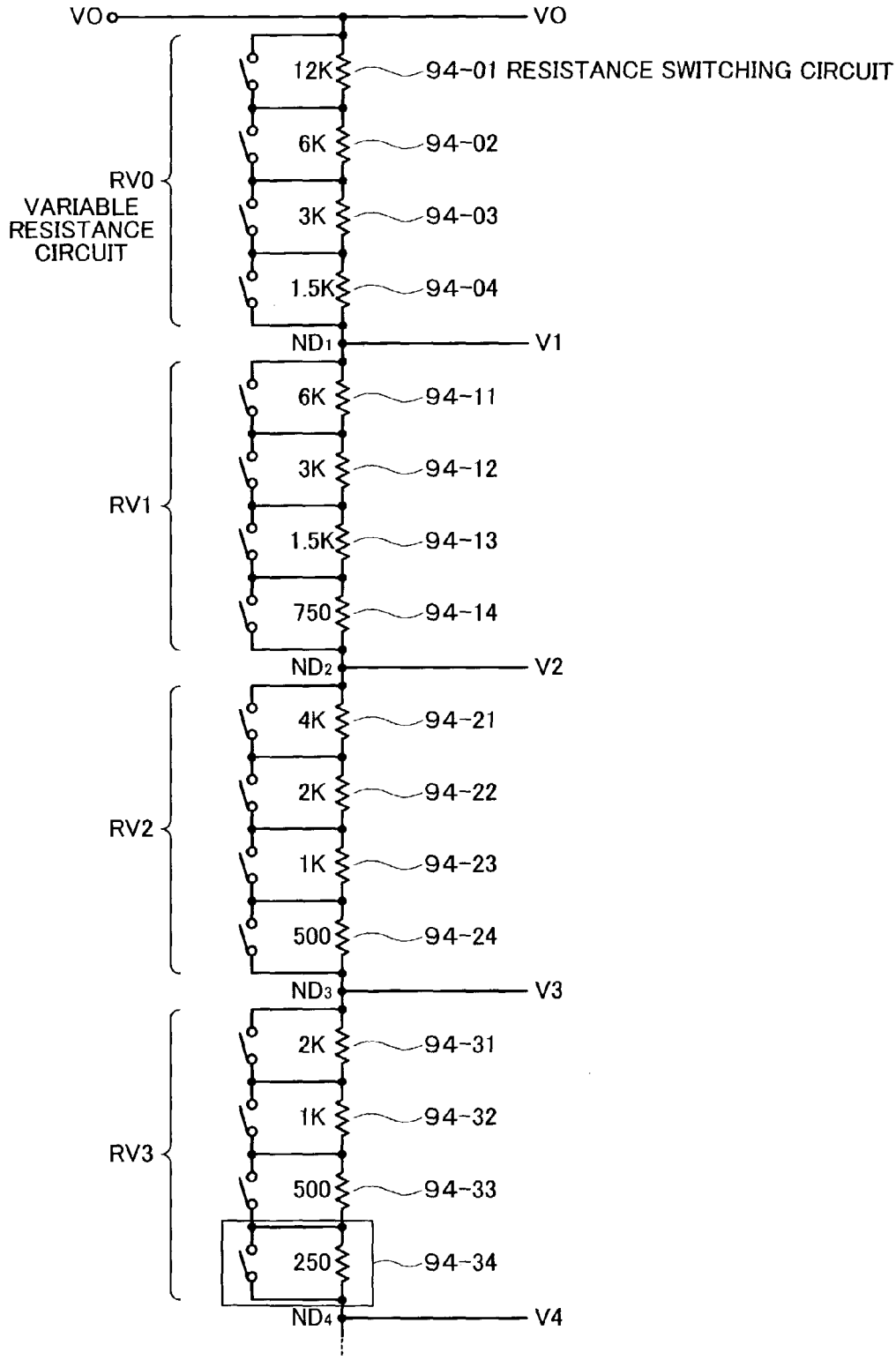
FIG. 20 is a circuit configuration diagram showing a part of the ladder resistance circuit in a fourth configuration example.

FIG. 20 shows a fourth configuration example of the ladder resistance circuit.

In this example, the ladder resistance circuit includes the variable resistance circuits VR0 to VR3 connected in series as shown in FIG. 19A, for example.

As shown in FIG. 20, the variable resistance circuit may be formed by serially connecting resistance switching circuits in which a resistance circuit and a switching circuit are connected in parallel. In this case, the switch element of the resistance switching circuit is ON-OFF controlled based on a given variable control signal.

For example, the variable resistance circuit VR0 may be formed by connecting resistance switching circuits 94-01 to 94-04 in series. The variable resistance circuit VR1 may be formed by connecting resistance switching circuits 94-11 to 94-14 in series. The variable resistance circuit VR2 may be formed by connecting resistance switching circuits 94-21 to 94-24 in series. The variable resistance circuit VR3 may be formed by connecting resistance switching circuits 94-31 to 94-34 in series.

According to this configuration, the impedance between the divided node and the power supply line can be decreased by variably controlling the resistance value of each variable resistance circuit between the first power supply line and the jth divided node, or variably controlling the resistance value of each resistance circuit between the second power supply line and the kth divided node. Therefore, effects the same as in the above-described configuration examples can be obtained.

3.3.5 Fifth Configuration Example

Figure 21:
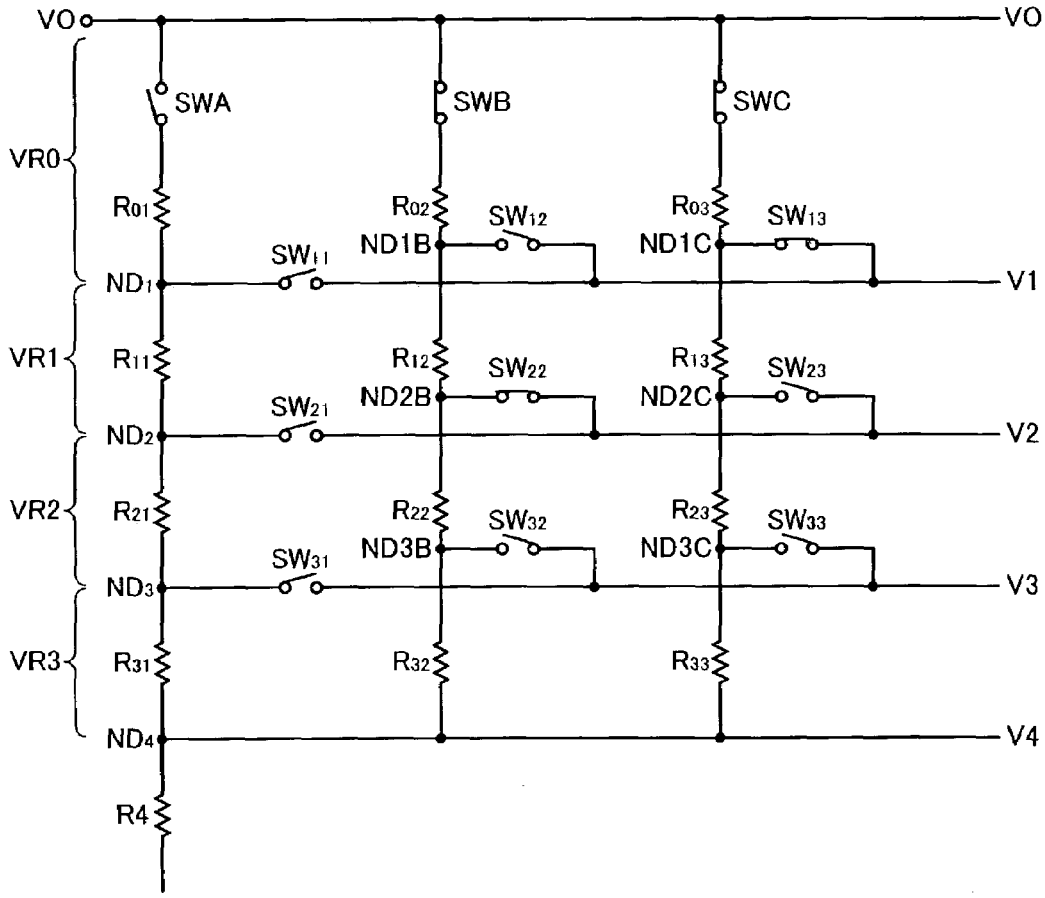
FIG. 21 is a circuit configuration diagram showing a part of the ladder resistance circuit in a fifth configuration example.

FIG. 21 shows a fifth configuration example of the ladder resistance circuit.

In this example, the ladder resistance circuit includes the variable resistance circuits VR0 to VR3 connected in series as shown in FIG. 19A, for example.

In the variable resistance circuit VR0, a switching circuit (switch element) SWA and a resistance circuit $R_{01}$ connected in series are inserted between the first power supply line and the first divided node $ND_1$. A switching circuit $SW_{11}$ is inserted between the first divided node $ND_1$ and the output node of the reference voltage V1. In the variable resistance circuit VR0, a switching circuit SWB and a resistance circuit $R_{02}$ connected in series are inserted between the first power supply line and a node ND1B. A switching circuit $SW_{12}$ is inserted between the node ND1B and the output node of the reference voltage V1. In the variable resistance circuit VR0, a switching circuit SWC and a resistance circuit $R_{03}$ connected in series are inserted between the first power supply line and a node ND1C. A switching circuit $SW_{13}$ is inserted between the node ND1C and the output node of the reference voltage V1.

In the variable resistance circuit VR1, a resistance circuit $R_{11}$ is inserted between the divided node $ND_1$ and the divided node $ND_2$. A switching circuit $SW_{21}$ is inserted between the divided node $ND_2$ and the output node of the reference voltage V2. In the variable resistance circuit VR1, a resistance circuit $R_{12}$ is inserted between the node ND1B and a node ND2B. A switching circuit $SW_{22}$ is inserted between the node ND2B and the output node of the reference voltage V2. In the variable resistance circuit VR1, a resistance circuit $R_{13}$ is inserted between the node ND1C and a node ND2C. A switching circuit $SW_{23}$ is inserted between the node ND2C and the output node of the reference voltage V2.

In the variable resistance circuit VR2, a resistance circuit $R_{21}$ is inserted between the divided node $ND_2$ and the divided node $ND_3$. A switching circuit $SW_{31}$ is inserted between the divided node $ND_3$ and the output node of the reference voltage V3. In the variable resistance circuit VR2, a resistance circuit $R_{22}$ is inserted between the node ND2B and a node ND3B. A switching circuit $SW_{32}$ is inserted between the node ND3B and the output node of the reference voltage V3. In the variable resistance circuit VR2, a resistance circuit $R_{23}$ is inserted between the node ND2C and a node ND3C. A switching circuit $SW_{33}$ is inserted between the node ND3C and the output node of the reference voltage V3.

In the variable resistance circuit VR3, a resistance circuit $R_{31}$ is inserted between the divided node $ND_3$ and the output node of the reference voltage V4. In the variable resistance circuit VR3, a resistance circuit $R_{32}$ is inserted between the node ND3B and the output node of the reference voltage V4. In the variable resistance circuit VR3, a resistance circuit $R_{33}$ is inserted between the node ND3C and the output node of the reference voltage V4.

The switching circuits SWA, SWB, SWC, $SW_{11}$ to $SW_{13}$, $SW_{21}$ to $SW_{23}$, and $SW_{31}$ to $SW_{33}$ are ON-OFF controlled based on a given variable control signal.

In the case where the switching circuits SWB, SWC, $SW_{13}$, and $SW_{22}$ are turned ON and the switching circuits SWA, $SW_{11}$, $SW_{12}$, $SW_{21}$, and $SW_{23}$ are turned OFF, a voltage that is the power supply voltage V0 dropped by the resistance circuit $R_{03}$ is output as the reference voltage V1, and a voltage that is the power supply voltage V0 dropped by the resistance circuit $R_{03}$ and the resistance circuit $R_{12}$ is output as the reference voltage V2.

According to this configuration, the impedance between the divided node and the power supply line can be decreased by variably controlling the resistance value of each variable resistance circuit between the first power supply line and the jth divided node, or variably controlling the resistance value of each resistance circuit between the second power supply line and the kth divided node. Therefore, effects the same as in the above-described configuration examples can be obtained.

3.3.6 Sixth Configuration Example

In the first to fifth configuration examples, the impedance is variably controlled by the resistance element and the switch element. However, the present invention is not limited thereto. In a sixth configuration example, the impedance is transformed by a voltage follower connected operational amplifier. Specifically, the reference voltage generation circuit includes the first and second impedance variable circuits 70 and 72 including voltage follower connected operational amplifiers for each divided node of the ladder resistance circuit connected in series between the first and second power supply lines. In this case, the resistance value of each resistance circuit of the ladder resistance circuit can be increased while securing the charge time by decreasing the impedance by variable control in the first control period of the drive period, and then allowing the impedance to be returned to the original value. Therefore, power consumption can be decreased.

Figure 22:
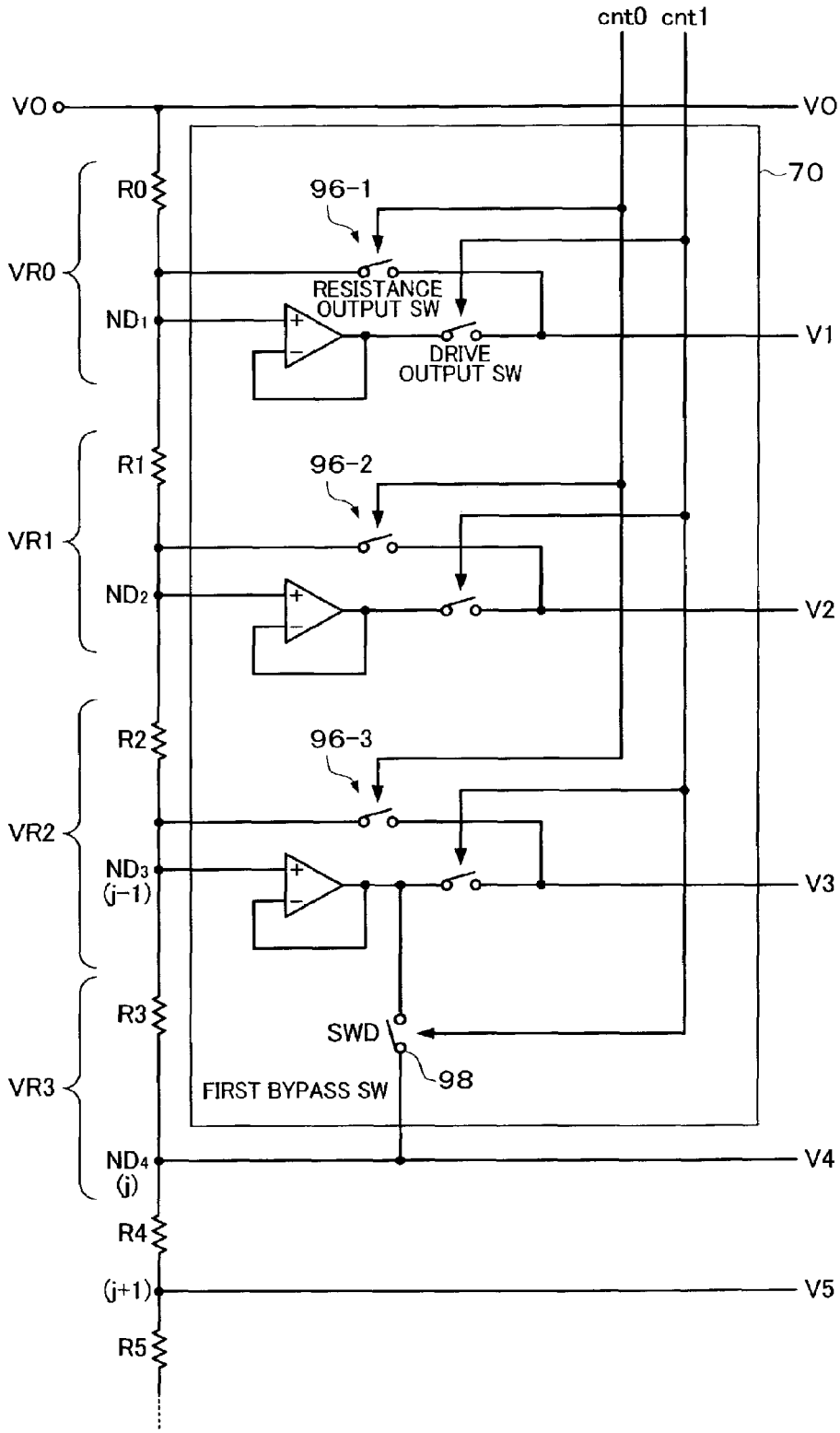
FIG. 22 is a circuit configuration diagram of the first impedance variable circuit in a sixth configuration example.

FIG. 22 shows the sixth configuration example of the ladder resistance circuit in which the voltage follower connected operational amplifiers are used.

In this example, the first impedance variable circuit 70 variably controls the impedance of the first to fourth divided nodes of the ladder resistance circuit including the variable resistance circuits VR0 to VR3 connected in series as shown in FIG. 19A. The variable resistance circuits VR0 to VR3 transform the impedance by providing the voltage follower circuits to the first to fourth divided nodes divided by the resistance of the resistance elements R0 to R3 of the ladder resistance circuit.

Specifically, in the first impedance variable circuit 70, first to (j−1)th voltage follower circuits 96-1 to **96-*j* are connected with the first to (j−1)th divided nodes. The voltage follower circuits 96-1 to 96-*j* include operational amplifiers which are voltage follower connected as shown in FIG. 4**, first to (j−1)th drive output-switching circuits inserted between the outputs of the first to (j−1)th voltage follower connected operational amplifiers and the first to (j−1)th reference voltage output nodes, and first to (j−1)th resistance output-switching circuits inserted between the first to (j−1)th divided nodes and the first to (j−1)th reference voltage output nodes. A first bypass switching circuit SWD is inserted between the output of the voltage follower type (j−1)th operational amplifier and the jth reference voltage output node.

The first to (j−1)th drive output-switching circuits and the first to (j−1)th resistance output-switching circuits are ON-OFF controlled by control signals cnt0 and cnt1.

Figure 23:
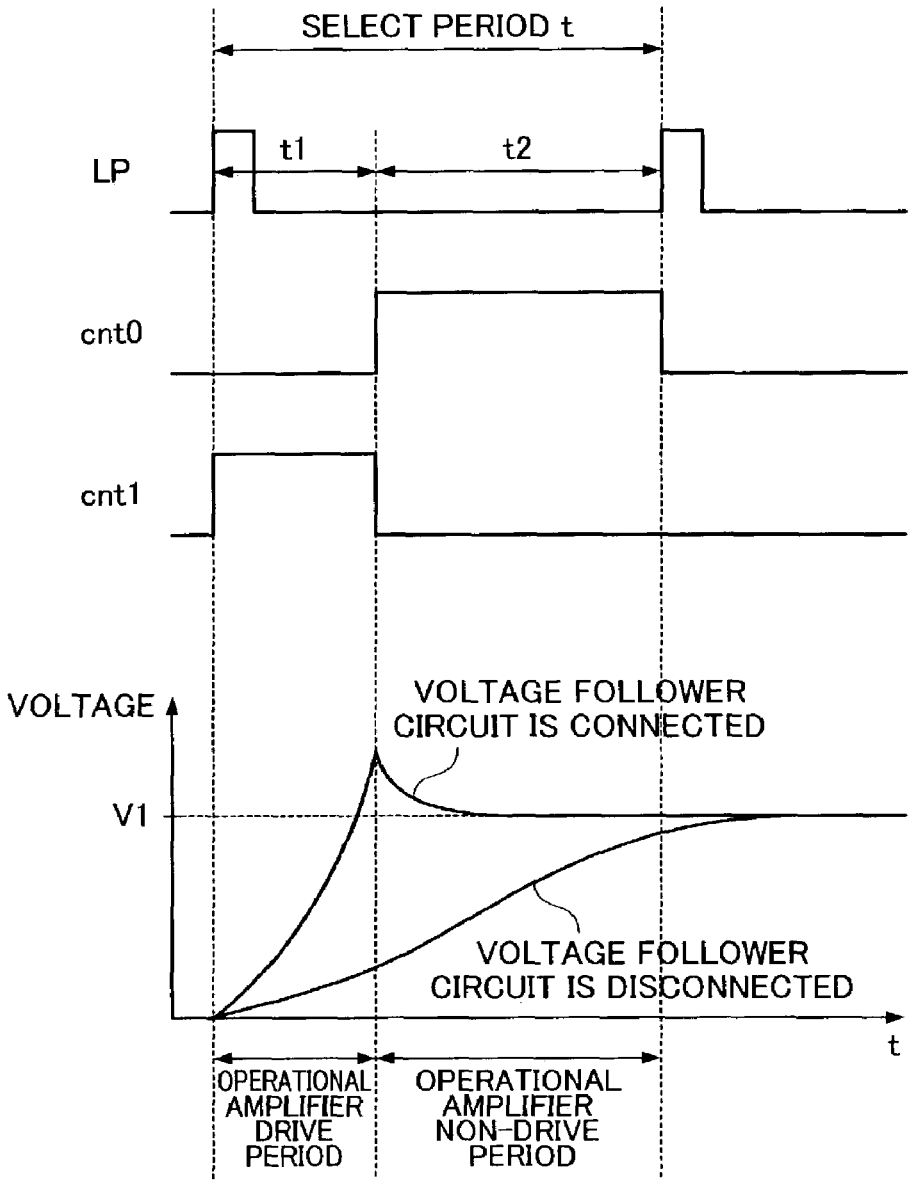
FIG. 23 is a timing chart showing the operation timing of the first impedance variable circuit in the sixth configuration example.

FIG. 23 shows an example of the control timing of the ladder resistance circuit shown in FIG. 22.

The logic levels of the control signals cnt0 and cnt1 are changed between the first period (given first period of drive period) t1 and the second period t2 of the select period (drive period) specified by the latch pulse signal LP, for example. When the logic level of the control signal cnto becomes "L" and the logic level of the control signal cnt1 becomes "H" in the first period t1, the outputs of the first to (j−1)th voltage follower type operational amplifiers are electrically connected with the first to (j−1)th reference voltage output nodes, and the first to (j−1)th divided nodes are electrically disconnected from the first to (j−1)th reference voltage output nodes. When the logic level of the control signal cnto becomes "H" and the logic level of the control signal cnt1 becomes "L" in the second period t2, the outputs of the first to (j−1)th voltage follower type operational amplifiers are electrically disconnected from the first to (j−1)th reference voltage output nodes, and the first to (j−1)th divided nodes are electrically connected with the first to (j−1)th reference voltage output nodes.

As described above, the output node of the reference voltage V1 is driven after impedance transformation by the voltage follower connected operational amplifier in the first period t1 of the select period t. In the second period t2, the voltage of the output node of the reference voltage V1 is determined through the resistance circuit R0. Specifically, the drive voltage Vout can be raised at high speed by the voltage follower connected operational amplifier having high drive capability in the first period t1 necessary for charging the liquid crystal capacitance, interconnect capacitance, and the like, and the drive voltage can be output by the resistance circuit R0 in the second period t2 in which high drive capability is unnecessary, as shown in FIG. 23.

Since the operating current steadily flows through the operational amplifiers of the voltage follower circuits 96-1 to 96-3 during operation, it is preferable to limit or terminate the operating current in the second period t2 of the select period t.

Figure 24:
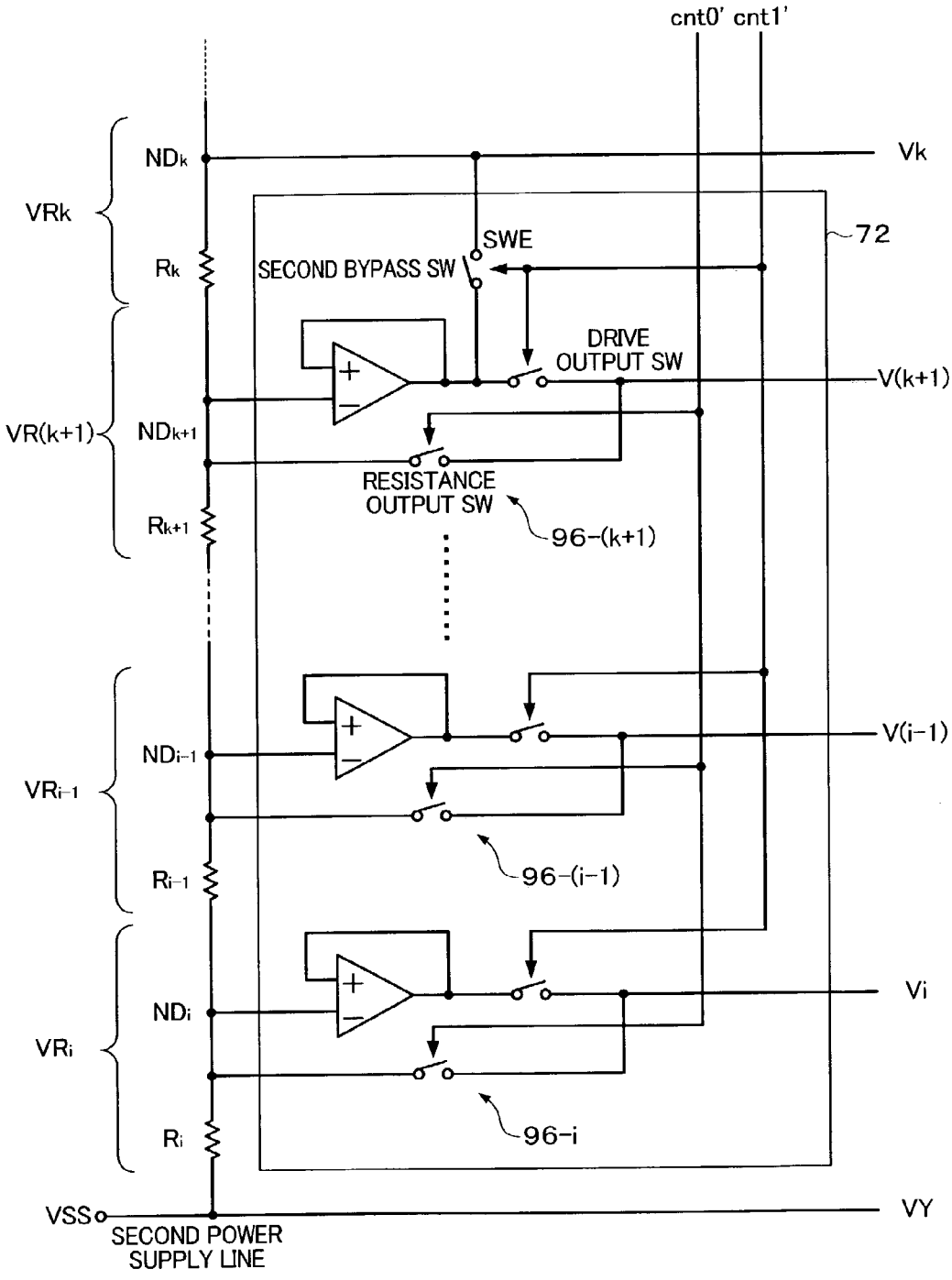
FIG. 24 is a circuit configuration diagram of the second impedance variable circuit in which the sixth configuration example is employed.

The second impedance variable circuit 72 may have a configuration as shown in FIG. 24 in the same manner as in FIG. 22. Specifically, the second impedance variable circuit 72 includes (k+1)th to ith voltage follower type operational amplifiers connected with the (k+1)th to ith divided nodes, (k+1)th to ith drive output-switching circuits inserted between the outputs of the (k+1)th to ith voltage follower type operational amplifiers and the (k+1)th to ith reference voltage output nodes, and (k+1)th to ith resistance output-switching circuits inserted between the (k+1)th to ith divided nodes and the (k+1)th to ith reference voltage output nodes. A second bypass switching circuit SWE is inserted between the output of the (k+1)th voltage follower type operational amplifier and the kth reference voltage output node.

The (k+1)th to ith drive output-switching circuits and the (k+1)th to ith resistance output-switching circuits are ON-OFF controlled by control signals cnt0' and cnt1'. As the control signal cnt0', a signal equal to the control signal cnt0 shown in FIG. 22 may be used. As the control signal cnt1', a signal equal to the control signal cnt1 shown in FIG. 22 may be used.

3.3.6.1 Modification Example

Figure 25:
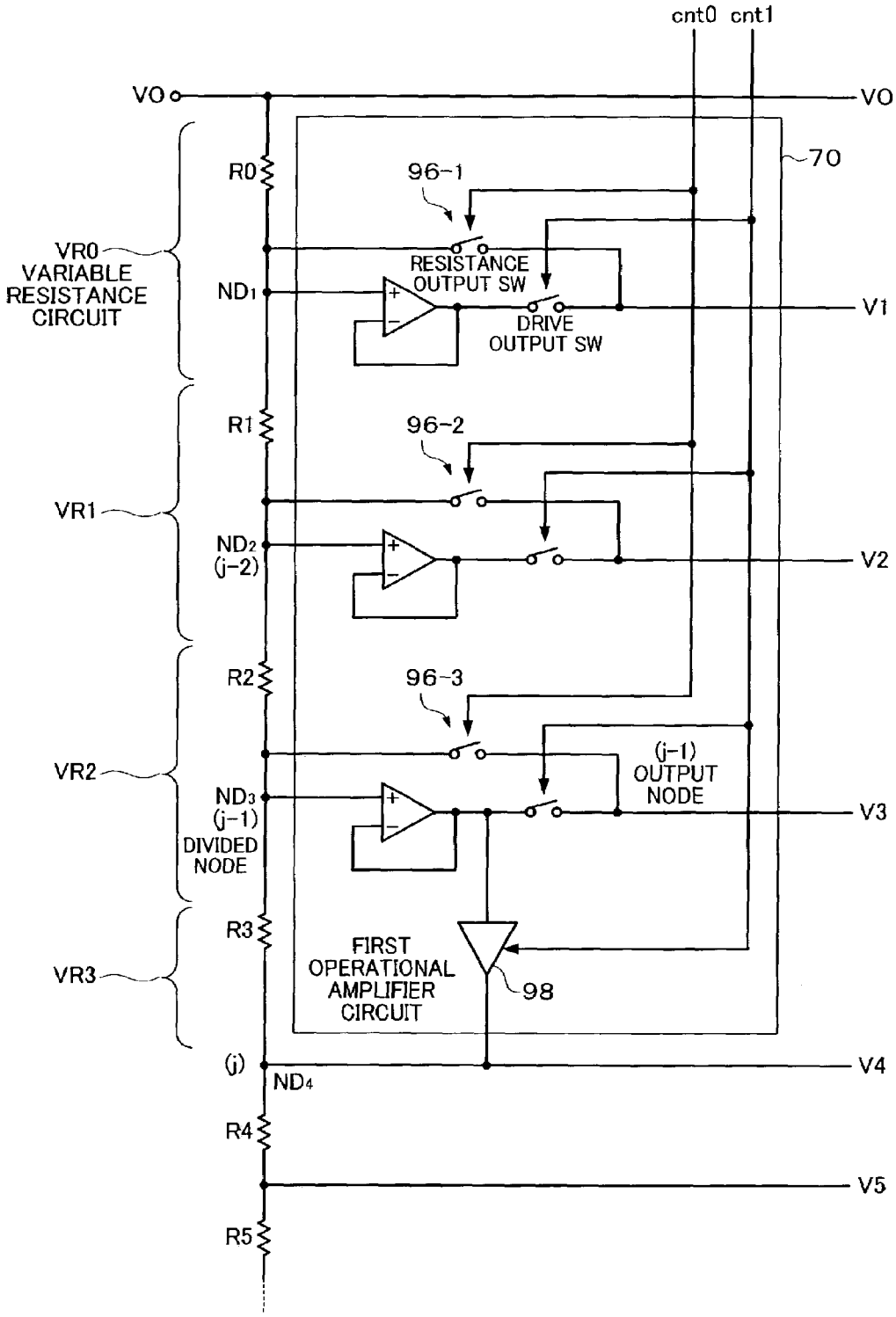
FIG. 25 is a circuit configuration diagram of the first impedance variable circuit in a modification example of the sixth configuration example.

As shown in FIG. 25, a first operational amplifier circuit 98 which outputs an output voltage to which an offset voltage is added may be provided instead of the switching circuit SWD shown in FIG. 22.

In the variable resistance circuit VR3 shown in FIG. 25, the first operational amplifier circuit 98 with an offset is inserted between the output terminal of the voltage follower connected operational amplifier of the voltage follower circuit 96-3 and the output node of the reference voltage V4. The operation of the operational amplifier circuit 98 is controlled by the control signal cnt1 (operating current is controlled by the control signal cnt1).

Figure 26:
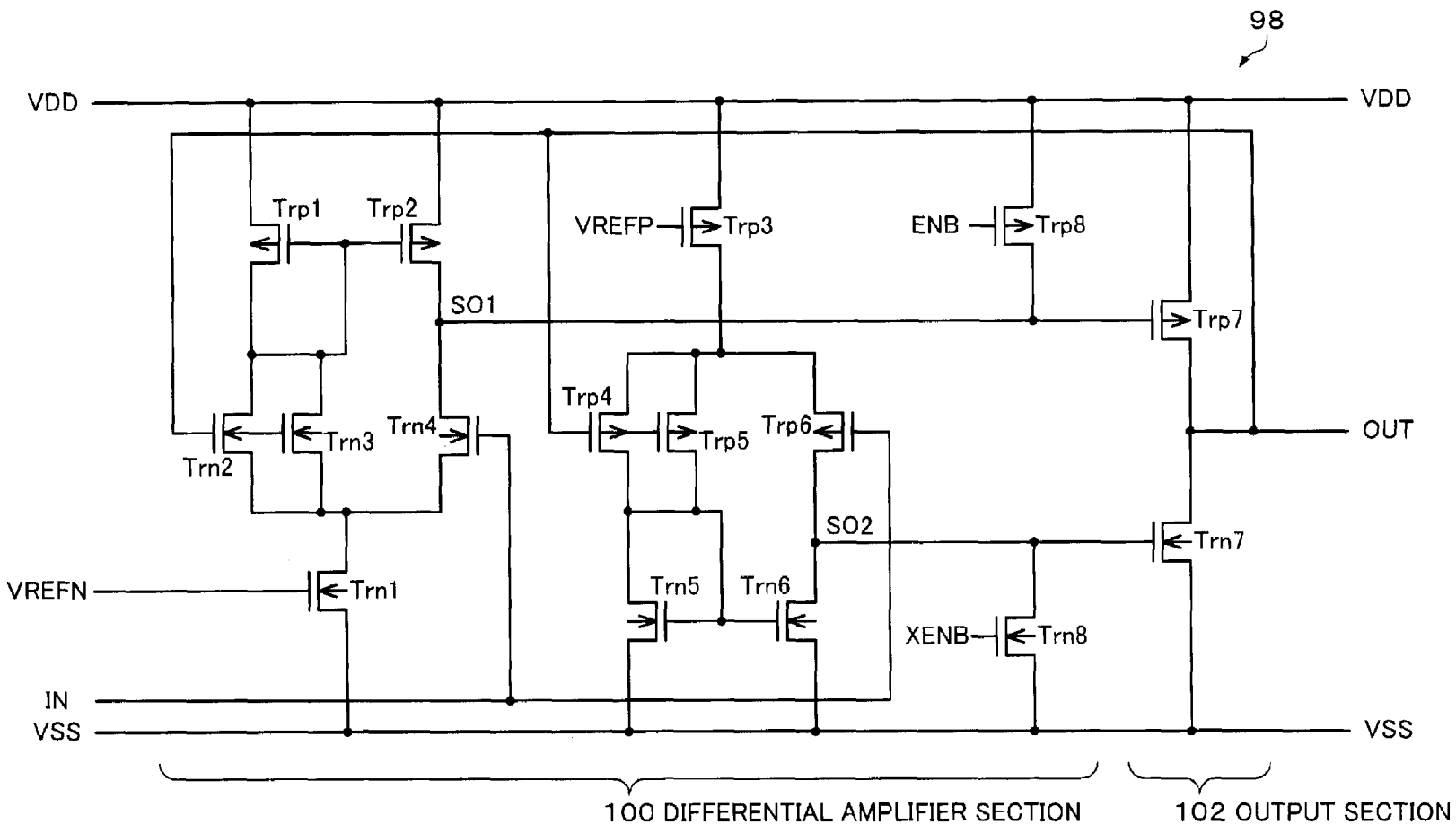
FIG. 26 is a circuit diagram showing a specific circuit configuration example of a first operational amplifier circuit.

FIG. 26 shows a detailed configuration example of the first operational amplifier circuit 98.

The first operational amplifier circuit 98 includes a differential amplifier section 100 and an output section 102.

The differential amplifier section 100 includes first and second differential amplifier sections 104 and 106.

The first differential amplifier section 104 utilizes current flowing between a drain and a source of an n-type MOS transistor Trn1 (n-type MOS transistor Trnx (x is an optional integer) is hereinafter abbreviated as "transistor Trnx") to which a reference signal VREFN is applied at a gate electrode as a current source. The current source is connected with source terminals of transistors Trn2 to Trn4. An output signal OUT of the first operational amplifier circuit 98 is applied to gate electrodes of the transistors Trn2 and Trn3. An input signal IN is applied to a gate electrode of the transistor Trn4.

The drain terminals of the transistors Trn2 to Trn4 are connected with drain terminals of p-type MOS transistors Trp1 and Trp2 having a current mirror structure (p-type MOS transistor Trpy (y is an optional integer) is hereinafter abbreviated as "transistor Trpy"). Gate electrodes of the transistors Trp1 and Trp2 are connected with drain terminals of the transistors Trn2 and Trn3.

A differential output signal SO1 is output from the drain terminal of the transistor Trp2.

The second differential amplifier section 106 utilizes current flowing between a drain and a source of a transistor Trp3 to which a reference signal VREFP is applied at a gate electrode as a current source. The current source is connected with source terminals of transistors Trp4 to Trp6. The output signal OUT of the first operational amplifier circuit 98 is applied to gate electrodes of the transistors Trp4 and Trp5. The input signal IN is applied to a gate electrode of the transistor Trp6.

The drain terminals of the transistors Trp4 to Trp6 are connected with drain terminals of transistors Trn5 and Trn6 having a current mirror structure. Gate electrodes of the transistors Trn5 and Trn6 are connected with the drain terminals of the transistors Trp4 and Trp5.

A differential output signal SO2 is output from the drain terminal of the transistor Trn6.

The output section 102 includes transistors Trp7 and Trn7 connected in series between the power supply voltage VDD and the ground power supply voltage VSS. The differential output signal SO1 is applied to a gate electrode of the transistor Trp7. The differential output signal SO2 is applied to a gate electrode of the transistor Trn7. The output signal OUT is output from drain terminals of the transistors Trp7 and Trn7.

The gate electrode of the transistor Trp7 is connected with a drain terminal of a transistor Trp8. A source terminal of the transistor Trp8 is connected with the power supply voltage VDD. An enable signal ENB is applied to a gate electrode of the transistor Trp8. The gate electrode of the transistor Trn7 is connected with a drain terminal of a transistor Trn8. A source terminal of the transistor Trn8 is connected with the ground power supply voltage VSS. An inverted enable signal XENB is applied to a gate electrode of the transistor Trn8.

Figure 27:
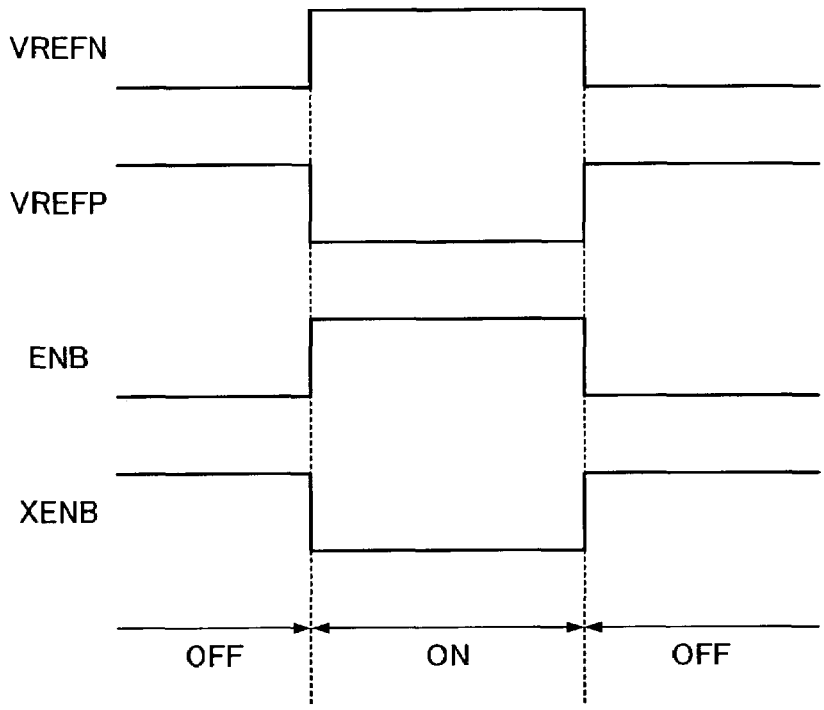
FIG. 27 is a timing chart showing the operation control timing of the first operational amplifier circuit.

The first operational amplifier circuit 98 having the above-described configuration outputs the output signal OUT which is the voltage of the input signal IN to which an offset is added by allowing the reference signals VREFN and VREFP, the enable signal ENB, and the inverted enable signal XENB to be operated as shown in FIG. 27. The control signal cnt1 shown in FIG. 23 may be used as the reference signal VREFN and the enable signal ENB. A signal obtained by inverting the control signal cnt1 may be used as the reference signal VREFP and the inverted enable signal XENB.

In the first differential amplifier section 104, when the logic level of the reference signal VREFN becomes "H" and the transistor Trn1 starts to be operated as the current source, a voltage corresponding to the difference in drive capability between the transistor Trn4 and the transistors Trn2 and Trn3 which make a differential pair is output as the differential output signal SO1 based on the output signal OUT and the input signal IN. At this time, since the transistor Trp8 is turned OFF, the differential output signal SO1 is applied to the gate electrode of the transistor Trp7. In the second differential amplifier section 106, the differential output signal SO2 is applied to the gate electrode of the transistor Trn7. As a result, the output section 102 outputs the output signal OUT which is the input signal IN to which an offset corresponding to the drive capability of the transistors which makes up the differential pair is added.

In the first differential amplifier section 104, since the amplification operation cannot be performed when the logic level of the reference signal VREFN becomes "L" and Trn1 is turned OFF, the power supply voltage VDD is applied to the gate electrode of the transistor Trp7 through the transistor Trp8. In the second differential amplifier section 106, the ground power supply voltage VSS is applied to the gate electrode of the transistor Trn7 through the transistor Trn8. As a result, the output section 102 puts its output in a high impedance state. Since the current flowing through the current source can be limited or terminated by the reference signals VREFN and VREFP, the operating current can be prevented from flowing in a period in which the operation is unnecessary.

According to this configuration, the first operational amplifier circuit 98 is capable of adding an offset with high accuracy. Therefore, the resistance value of the variable resistance circuit can be variably controlled by using impedance transformation by the voltage follower circuit, whereby the impedance from the power supply can be made variable. It is preferable to limit or terminate the operating current of the first operational amplifier circuit 98 in the second period t2 of the select period t.

Figure 28:
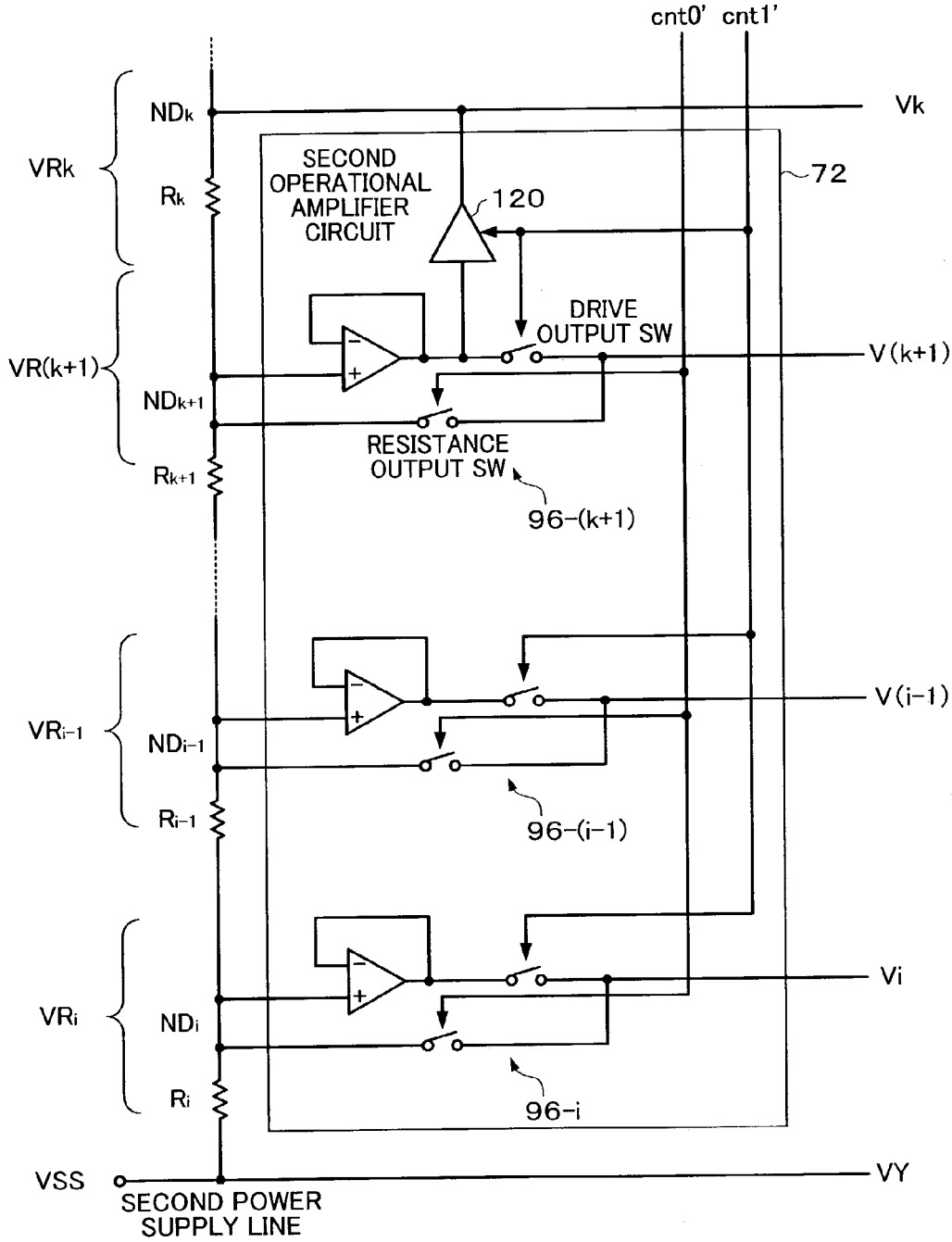
FIG. 28 is a circuit configuration diagram of the second impedance variable circuit in the modification example of the sixth configuration example.

As shown in FIG. 28, a second operational amplifier circuit 120 may be used in the second impedance variable circuit 72 instead of the switching circuit SWE shown in FIG. 24. Specifically, the second impedance variable circuit 72 includes (k+1)th to ith voltage follower type operational amplifiers connected with the (k+1)th to ith divided nodes, (k+1)th to ith drive output-switching circuits inserted between the outputs of the (k+1)th to ith voltage follower type operational amplifiers and the (k+1)th to ith reference voltage output nodes, (k+1)th to ith resistance output-switching circuits inserted between the (k+1)th to ith divided nodes and the (k+1)th to ith reference voltage output nodes, and the second operational amplifier circuit 120 inserted between the output of the (k+1)th voltage follower type operational amplifier and the kth reference voltage output node. The second operational amplifier circuit 120 outputs a voltage generated by adding a given offset voltage to a voltage output from the (k+1)th reference voltage Vk, to the kth reference voltage output node.

The operation of the second operational amplifier circuit 120 can be controlled by the control signal cnt1' in the same manner as the first operational amplifier circuit 98 shown in FIG. 25, for example. It is also preferable to limit or terminate the operating current of the second operational amplifier circuit 120 in the second period t2 of the select period t.

4. Others

The above embodiments are described taking the liquid crystal device including a liquid crystal panel using TFTs as an example. However, the present invention is not limited thereto. The reference voltage generated by the reference voltage generation circuit 48 may be changed into current by a given current conversion circuit and supplied to a current driven type element. This enables the present invention to be applied to a signal driver IC which drives an organic EL panel including organic EL elements provided corresponding to pixels specified by signal electrodes and scan electrodes, for example.

Figure 29:
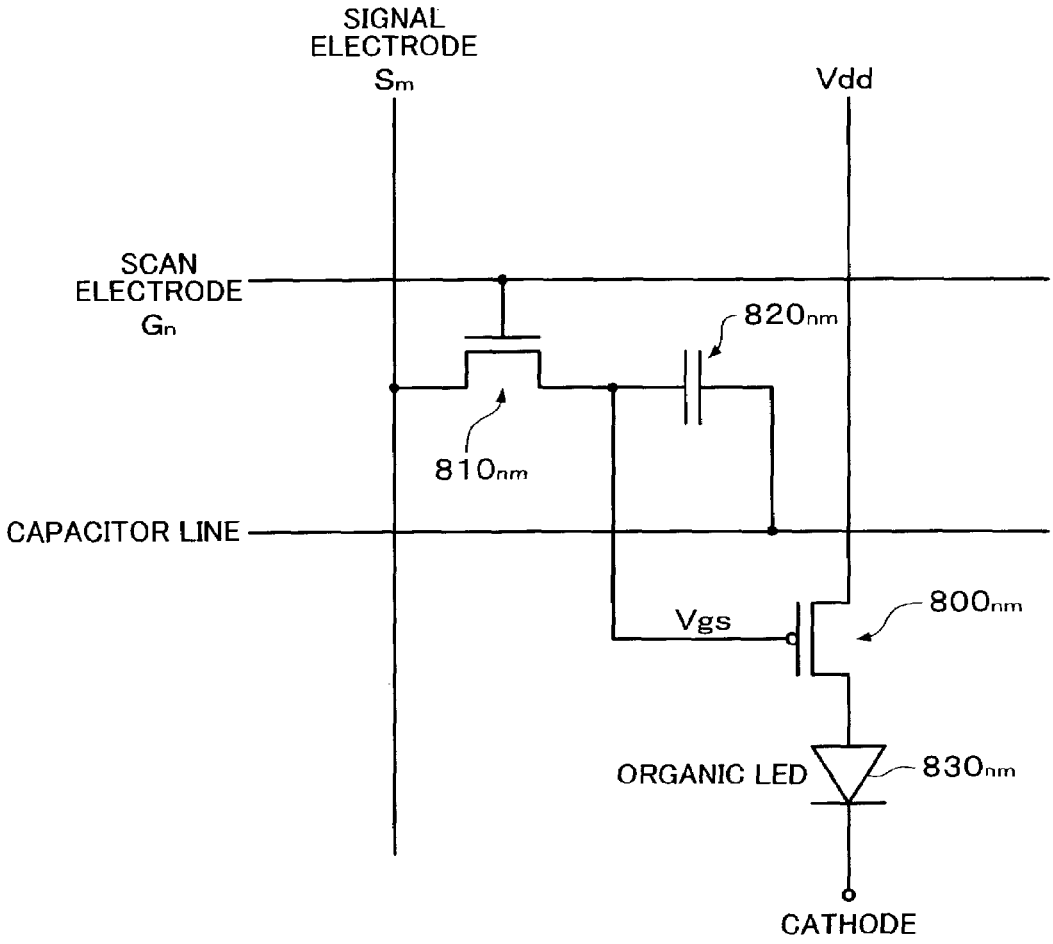
FIG. 29 is a configuration diagram showing an example of a two transistor type pixel circuit in an organic EL panel.

FIG. 29 shows an example of a two transistor type pixel circuit in an organic EL panel driven by such a signal driver IC.

The organic EL panel includes a drive TFT $\mathbf{800}_{nm}$, a switch TFT $\mathbf{810}_{nm}$, a storage capacitor $\mathbf{820}_{nm}$, and an organic LED $\mathbf{830}_{nm}$ at an intersection point between a signal electrode $S_m$ and a scan electrode $G_n$. The drive TFT $\mathbf{800}_{nm}$ is formed by a p-type transistor.

The drive TFT $\mathbf{800}_{nm}$ and the organic LED $\mathbf{830}_{nm}$ are connected in series with a power supply line.

The switch TFT $\mathbf{810}_{nm}$ is inserted between a gate electrode of the drive TFT $\mathbf{800}_{nm}$ and the signal electrode $S_m$. A gate electrode of the switch TFT $\mathbf{810}_{nm}$ is connected with the scan electrode $G_n$.

The storage capacitor $\mathbf{820}_{nm}$ is inserted between the gate electrode of the drive TFT $\mathbf{800}_{nm}$ and a capacitor line.

In this organic EL element, when the scan electrode $G_n$ is driven and the switch TFT $\mathbf{810}_{nm}$ is turned ON, a voltage of the signal electrode $S_m$ is written into the storage capacitor $\mathbf{820}_{nm}$ and applied to the gate electrode of the drive TFT $\mathbf{800}_{nm}$. A gate voltage Vgs of the drive TFT $\mathbf{800}_{nm}$ is determined depending on the voltage of the signal electrode $S_m$, whereby current flowing through the drive TFT $\mathbf{800}_{nm}$ is determined. Since the drive TFT $\mathbf{800}_{nm}$ and the organic LED $\mathbf{830}_{nm}$ are connected in series, the current flowing through the drive TFT $\mathbf{800}_{nm}$ also flows through the organic LED $\mathbf{830}_{nm}$.

Therefore, if the gate voltage Vgs corresponding to the voltage of the signal electrode $S_m$ is held by the storage capacitor $\mathbf{820}_{nm}$, for example, in the case where current corresponding to the gate voltage Vgs is caused to flow through the organic LED $\mathbf{830}_{nm}$ in one frame period, a pixel which continues to shine during the frame period can be realized.

Figure 30A:
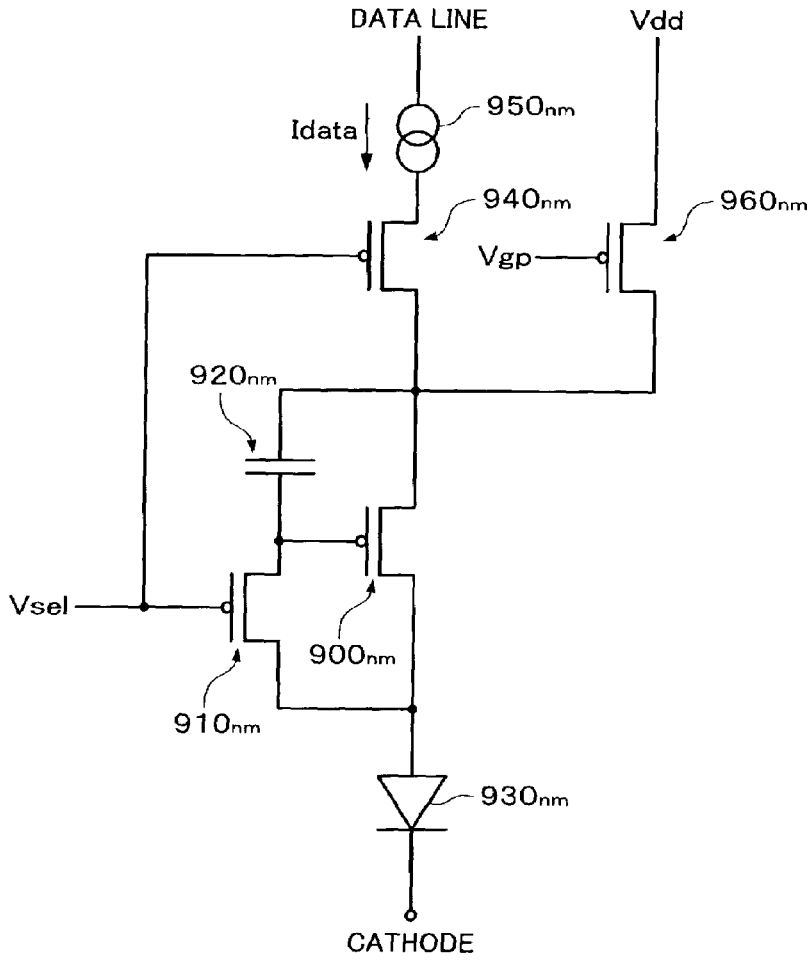
FIG. 30A is a circuit configuration diagram showing an example of a four transistor type pixel circuit in an organic EL panel.
Figure 30B:
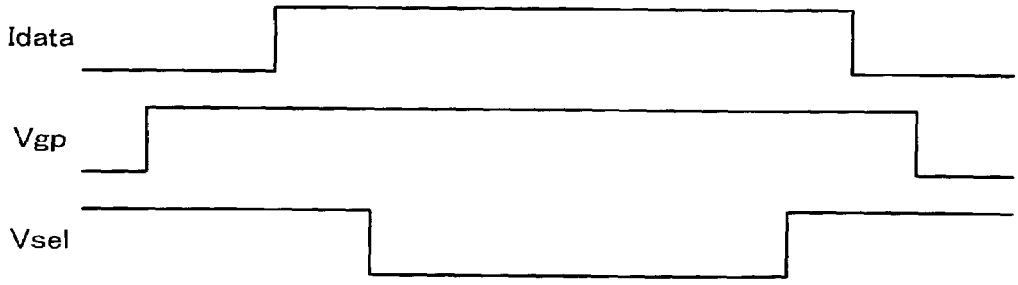
FIG. 30B is a timing chart showing an example of the display control timing of the pixel circuit.

FIG. 30A shows an example of a four transistor type pixel circuit in an organic EL panel driven by using the signal driver IC. FIG. 30B shows an example of the display control timing of the pixel circuit.

The organic EL panel includes a drive TFT $\mathbf{900}_{nm}$, a switch TFT $\mathbf{910}_{nm}$, a storage capacitor $\mathbf{920}_{nm}$, and an organic LED $\mathbf{930}_{nm}$.

The features differing from the two transistor type pixel circuit shown in FIG. 29 are that a constant current Idata from a constant current source $\mathbf{950}_{nm}$ is supplied to the pixel through a p-type TFT $\mathbf{940}_{nm}$ as a switch element instead of a constant voltage, and the storage capacitor $\mathbf{920}_{nm}$ and the drive TFT $\mathbf{900}_{nm}$ are connected with the power supply line through a p-type TFT $\mathbf{960}_{nm}$ as a switch element.

In this organic EL element, the power supply line is disconnected by allowing the p-type TFT $\mathbf{960}_{nm}$ to be turned OFF by a gate voltage Vgp, and the constant current Idata from the constant current source $\mathbf{950}_{nm}$ is caused to flow through the drive TFT $\mathbf{900}_{nm}$ by allowing the p-type TFT $\mathbf{940}_{nm}$ and the switch TFT $\mathbf{910}_{nm}$ to be turned ON by a gate voltage Vsel.

A voltage corresponding to the constant current Idata is held by the storage capacitor $\mathbf{920}_{nm}$ until the current flowing through the drive TFT $\mathbf{900}_{nm}$ becomes stable.

The p-type TFT $\mathbf{940}_{nm}$ and the switch TFT $\mathbf{910}_{nm}$ are turned OFF by the gate voltage Vsel and the p-type TFT $\mathbf{960}_{nm}$ is turned ON by the gate voltage Vgp, whereby the power supply line is electrically connected with the drive TFT $\mathbf{900}_{nm}$ and the organic LED $\mathbf{930}_{nm}$. Current almost equal to or in an amount corresponding to the constant current Idata is supplied to the organic LED $\mathbf{930}_{nm}$ by the voltage retained by the storage capacitor $\mathbf{920}_{nm}$.

In this organic EL element, the scan electrode may be used as an electrode to which the gate voltage Vsel is applied, and the signal electrode may be used as a data line.

The organic LED may have a structure in which a light-emitting layer is provided on a transparent anode (ITO) and a metal cathode is provided on the light-emitting layer, or a structure in which a light-emitting layer, a light-transmitting cathode, and transparent seal are provided on a metal anode. The element structure of the organic LED is not limited.

A signal driver IC which is widely used for organic EL panels can be provided by forming a signal driver IC which drives an organic EL panel including organic EL elements as described above.

The present invention is not limited to the above-described embodiments. Various modifications and variations are possible within the spirit and scope of the present invention. For example, the present invention may be applied to plasma display devices.

As the variable control signal for variably controlling the impedance between the divided node and the first or second power supply line, a given command input by the user or a control signal input through an external input terminal may be used.

A circuit which variably controls the impedance of the ladder resistance circuit maybe formed by optionally combining the first to sixth configuration examples.

What is claimed is:

1. A reference voltage generation circuit which generates multi-valued reference voltages for generating grayscale values which are gamma-corrected based on grayscale data, comprising:

a ladder resistance circuit which comprises a plurality of resistance circuits connected in series between first and second power supply lines to which first and second power supply voltages are respectively supplied, and outputs voltages of first to ith (i is an integer of two or more) divided nodes, which are formed by dividing the ladder resistance circuit by the resistance circuits, as first to ith reference voltages;

a first impedance variable circuit which changes a first impedance value which is an impedance between jth (j is a natural number) divided node and the first power supply line; and a second impedance variable circuit which changes a second impedance value which is an impedance between kth ($1 \leqq j < k \leqq i$, k is an integer) divided node and the second power supply line, wherein the first and second impedance variable circuits decrease the first and second impedance values during a given control period in a drive period based on the grayscale data, and wherein the first and second impedance variable circuits return the first and second impedance values to given first and second values after the control period has elapsed.

2. The reference voltage generation circuit as defined in claim 1, wherein the first impedance variable circuit comprises a first resistance bypass circuit inserted between the first power supply line and the jth divided node, wherein the first resistance bypass circuit electrically connects the first power supply line with the jth divided node during the control period, and wherein the first resistance bypass circuit electrically disconnects the first power supply line from the jth divided node after the control period has elapsed.

3. The reference voltage generation circuit as defined in claim 2, wherein the second impedance variable circuit comprises a second resistance bypass circuit inserted between the second power supply line and the kth divided node, wherein the second resistance bypass circuit electrically connects the second power supply line with the kth divided node during the control period, and wherein the second resistance bypass circuit electrically disconnects the second power supply line from the kth divided node after the control period has elapsed.

4. A display driver circuit comprising:

the reference voltage generation circuit as defined in claim 2;

a voltage select circuit which selects a voltage from multi-valued reference voltages generated by the reference voltage generation circuit based on grayscale data; and a signal electrode driver circuit which drives a signal electrode by using the voltage selected by the voltage select circuit.

5. The reference voltage generation circuit as defined in claim 1, wherein the first impedance variable circuit comprises first to jth switching circuits which respectively bypass the first power supply line with the first to jth divided nodes, and wherein the first to jth switching circuits sequentially disconnect the jth to first divided nodes electrically from the first power supply line after electrically connecting the first power supply line with all of the first to jth divided nodes.

6. The reference voltage generation circuit as defined in claim 5, wherein the second impedance variable circuit comprises kth to ith switching circuits which respectively bypass the second power supply line with the kth to ith divided nodes, and wherein the kth to ith switching circuits sequentially disconnect the kth to ith divided nodes electrically from the second power supply line after electrically connecting the second power supply line with the kth to ith divided nodes.

7. A display driver circuit comprising:

the reference voltage generation circuit as defined in claim 5;

a voltage select circuit which selects a voltage from multi-valued reference voltages generated by the reference voltage generation circuit based on grayscale data; and a signal electrode driver circuit which drives a signal electrode by using the voltage selected by the voltage select circuit.

8. The reference voltage generation circuit as defined in claim 1, wherein the first impedance variable circuit comprises:

first to (j−1)th voltage follower type operational amplifiers of which inputs are connected with the first to (j−1)th divided nodes;

first to (j−1)th drive output-switching circuits inserted between outputs of the first to (j−1)th voltage follower type operational amplifiers and first to (j−1)th reference voltage output nodes;

first to (j−1)th resistance output-switching circuits inserted between the first to (j−1)th divided nodes and the first to (j−1)th reference voltage output nodes; and a first bypass switching circuit inserted between the output of the (j−1)th voltage follower type operational amplifier and the jth reference voltage output node, wherein the first to (j−1)th drive output-switching circuits electrically connect the outputs of the first to (j−1)th voltage follower type operational amplifiers with the first to (j−1)th reference voltage output nodes during the control period, wherein the first to (j−1)th drive output-switching circuits electrically disconnect the outputs of the first to (j−1)th voltage follower type operational amplifiers from the first to (j−1)th reference voltage output nodes after the control period has elapsed, wherein the first to (j−1)th resistance output-switching circuits electrically disconnect the first to (j−1)th divided nodes from the first to (j−1)th reference voltage output nodes during the control period, wherein the first to (j−1)th resistance output-switching circuits electrically connect the first to (j−1)th divided nodes with the first to (j−1)th reference voltage output nodes after the control period has elapsed, wherein the first bypass switching circuit electrically connects the output of the (j−1)th voltage follower type operational amplifier with the jth reference voltage output node during the control period, and wherein the first bypass switching circuit electrically disconnects the output of the (j−1)th voltage follower type operational amplifier from the jth reference voltage output node after the control period has elapsed.

9. The reference voltage generation circuit as defined in claim 8, wherein the second impedance variable circuit comprises:

(k+1)th to ith voltage follower type operational amplifiers of which inputs are connected with the (k+1)th to ith divided nodes;

(k+1)th to ith drive output-switching circuits inserted between outputs of the (k+1)th to ith voltage follower type operational amplifiers and (k+1)th to ith reference voltage output nodes;

(k+1)th to ith resistance output-switching circuits inserted between the (k+1)th to ith divided nodes and the (k+1)th to ith reference voltage output nodes; and a second bypass switching circuit inserted between the output of the (k+1)th voltage follower type operational amplifier and the kth reference voltage output node, wherein the (k+1)th to ith drive output-switching circuits electrically connect the outputs of the (k+1)th to ith voltage follower type operational amplifiers with the (k+1)th to ith reference voltage output nodes during the control period, wherein the (k+1)th to ith drive output-switching circuits electrically disconnect the outputs of the (k+1)th to ith voltage follower type operational amplifiers from the (k+1)th to ith reference voltage output nodes after the control period has elapsed, wherein the (k+1)th to ith resistance output-switching circuits electrically disconnect the (k+1)th to ith divided nodes from the (k+1)th to ith reference voltage output nodes during the control period, wherein the (k+1)th to ith resistance output-switching circuits electrically connect the (k+1)th to ith divided nodes with the (k+1)th to ith reference voltage output nodes after the control period has elapsed, wherein the second bypass switching circuit electrically connects the output of the (k+1)th voltage follower type operational amplifier with the kth reference voltage output node during the control period, and wherein the second bypass switching circuit electrically disconnects the output of the (k+1)th voltage follower type operational amplifier from the kth reference voltage output node after the control period has elapsed.

10. A display driver circuit comprising:

the reference voltage generation circuit as defined in claim 8;

a voltage select circuit which selects a voltage from multi-valued reference voltages generated by the reference voltage generation circuit based on grayscale data; and a signal electrode driver circuit which drives a signal electrode by using the voltage selected by the voltage select circuit.

11. The reference voltage generation circuit as defined in claim 1, wherein the first impedance variable circuit comprises:

first to (j−1)th voltage follower type operational amplifiers of which inputs are connected with the first to (j−1)th divided nodes;

first to (j−1)th drive output-switching circuits inserted between outputs of the first to (j−1)th voltage follower type operational amplifiers and first to (j−1)th reference voltage output nodes;

first to (j−1)th resistance output-switching circuits inserted between the first to (j−1)th divided nodes and the first to (j−1)th reference voltage output nodes; and a first operational amplifier circuit inserted between the output of the (j−1)th voltage follower type operational amplifier and the jth reference voltage output node, wherein the first to (j−1)th drive output-switching circuits electrically connect the outputs of the first to (j−1)th voltage follower type operational amplifiers with the first to (j−1)th reference voltage output nodes during the control period, wherein the first to (j−1)th drive output-switching circuits electrically disconnect the outputs of the first to (j−1)th voltage follower type operational amplifiers from the first to (j−1)th reference voltage output nodes after the control period has elapsed, wherein the first to (j−1)th resistance output-switching circuits electrically disconnect the first to (j−1)th divided nodes from the first to (j−1)th reference voltage output nodes during the control period, wherein the first to (j−1)th resistance output-switching circuits electrically connect the first to (j−1)th divided nodes with the first to (j−1)th reference voltage output nodes after the control period has elapsed, wherein the first operational amplifier circuit outputs a voltage generated by adding a given offset voltage to a voltage output from the (j−1)th voltage follower type operational amplifier, to the jth reference voltage output node during the control period, and wherein an operating current of the first operational amplifier circuit is limited or terminated after the control period has elapsed.

12. The reference voltage generation circuit as defined in claim 11, wherein the second impedance variable circuit comprises:

(k+1)th to ith voltage follower type operational amplifiers of which inputs are connected with the (k+1)th to ith divided nodes;

(k+1)th to ith drive output-switching circuits inserted between outputs of the (k+1)th to ith voltage follower type operational amplifiers and (k+1)th to ith reference voltage output nodes;

(k+1)th to ith resistance output-switching circuits inserted between the (k+1)th to ith divided nodes and the (k+1)th to ith reference voltage output nodes; and a second operational amplifier circuit inserted between the output of the (k+1)th voltage follower type operational amplifier and the kth reference voltage output node, wherein the (k+1)th to ith drive output-switching circuits electrically connect the outputs of the (k+1)th to ith voltage follower type operational amplifiers with the (k+1)th to ith reference voltage output nodes during the control period, wherein the (k+1)th to ith drive output-switching circuits electrically disconnect the outputs of the (k+1)th to ith voltage follower type operational amplifiers from the (k+1)th to ith reference voltage output nodes after the control period has elapsed, wherein the (k+1)th to ith resistance output-switching circuits electrically disconnect the (k+1)th to ith divided nodes from the (k+1)th to ith reference voltage output nodes during the control period, wherein the (k+1)th to ith resistance output-switching circuits electrically connect the (k+1)th to ith divided nodes with the (k+1)th to ith reference voltage output nodes after the control period has elapsed, wherein the second operational amplifier circuit outputs a voltage generated by adding a given offset voltage to a voltage output from the (k+1)th voltage follower type operational amplifier, to the kth reference voltage output node during the control period, and wherein an operating current of the second operational amplifier circuit is limited or terminated after the control period has elapsed.

13. A display driver circuit comprising:

the reference voltage generation circuit as defined in claim 11;

a voltage select circuit which selects a voltage from multi-valued reference voltages generated by the reference voltage generation circuit based on grayscale data; and a signal electrode driver circuit which drives a signal electrode by using the voltage selected by the voltage select circuit.

14. The reference voltage generation circuit as defined in claim 1, wherein the second impedance variable circuit comprises a second resistance bypass circuit inserted between the second power supply line and the kth divided node, wherein the second resistance bypass circuit electrically connects the second power supply line with the kth divided node during the control period, and wherein the second resistance bypass circuit electrically disconnects the second power supply line from the kth divided node after the control period has elapsed.

15. A display driver circuit comprising:

the reference voltage generation circuit as defined in claim 14;

a voltage select circuit which selects a voltage from multi-valued reference voltages generated by the reference voltage generation circuit based on grayscale data; and a signal electrode driver circuit which drives a signal electrode by using the voltage selected by the voltage select circuit.

16. The reference voltage generation circuit as defined in claim 1, wherein the second impedance variable circuit comprises kth to ith switching circuits which respectively bypass the second power supply line with the kth to ith divided nodes, and wherein the kth to ith switching circuits sequentially disconnect the kth to ith divided nodes electrically from the second power supply line after electrically connecting the second power supply line with the kth to ith divided nodes.

17. A display driver circuit comprising:

the reference voltage generation circuit as defined in claim 16;

a voltage select circuit which selects a voltage from multi-valued reference voltages generated by the reference voltage generation circuit based on grayscale data; and a signal electrode driver circuit which drives a signal electrode by using the voltage selected by the voltage select circuit.

18. The reference voltage generation circuit as defined in claim 1, wherein the second impedance variable circuit comprises:

(k+1)th to ith voltage follower type operational amplifiers of which inputs are connected with the (k+1)th to ith divided nodes;

(k+1)th to ith drive output-switching circuits inserted between outputs of the (k+1)th to ith voltage follower type operational amplifiers and (k+1)th to ith reference voltage output nodes;

(k+1)th to ith resistance output-switching circuits inserted between the (k+1)th to ith divided nodes and the (k+1)th to ith reference voltage output nodes; and a second bypass switching circuit inserted between the output of the (k+1)th voltage follower type operational amplifier and the kth reference voltage output node, wherein the (k+1)th to ith drive output-switching circuits electrically connect the outputs of the (k+1)th to ith voltage follower type operational amplifiers with the (k+1)th to ith reference voltage output nodes during the control period, wherein the (k+1)th to ith drive output-switching circuits electrically disconnect the outputs of the (k+1)th to ith voltage follower type operational amplifiers from the (k+1)th to ith reference voltage output nodes after the control period has elapsed, wherein the (k+1)th to ith resistance output-switching circuits electrically disconnect the (k+1)th to ith divided nodes from the (k+1)th to ith reference voltage output nodes during the control period, wherein the (k+1)th to ith resistance output-switching circuits electrically connect the (k+1)th to ith divided nodes with the (k+1)th to ith reference voltage output nodes after the control period has elapsed, wherein the second bypass switching circuit electrically connects the output of the (k+1)th voltage follower type operational amplifier with the kth reference voltage output node during the control period, and wherein the second bypass switching circuit electrically disconnects the output of the (k+1)th voltage follower type operational amplifier from the kth reference voltage output node after the control period has elapsed.

19. A display driver circuit comprising:

the reference voltage generation circuit as defined in claim 18;

a voltage select circuit which selects a voltage from multi-valued reference voltages generated by the reference voltage generation circuit based on grayscale data; and a signal electrode driver circuit which drives a signal electrode by using the voltage selected by the voltage select circuit.

20. The reference voltage generation circuit as defined in claim 1, wherein the second impedance variable circuit comprises:

(k+1)th to ith voltage follower type operational amplifiers of which inputs are connected with the (k+1)th to ith divided nodes;

(k+1)th to ith drive output-switching circuits inserted between outputs of the (k+1)th to ith voltage follower type operational amplifiers and (k+1)th to ith reference voltage output nodes;

(k+1)th to ith resistance output-switching circuits inserted between the (k+1)th to ith divided nodes and the (k+1)th to ith reference voltage output nodes; and a second operational amplifier circuit inserted between the output of the (k+1)th voltage follower type operational amplifier and the kth reference voltage output node, wherein the (k+1)th to ith drive output-switching circuits electrically connect the outputs of the (k+1)th to ith voltage follower type operational amplifiers with the (k+1)th to ith reference voltage output nodes during the control period, wherein the (k+1)th to ith drive output-switching circuits electrically disconnect the outputs of the (k+1)th to ith voltage follower type operational amplifiers from the (k+1)th to ith reference voltage output nodes after the control period has elapsed, wherein the (k+1)th to ith resistance output-switching circuits electrically disconnect the (k+1)th to ith divided nodes from the (k+1)th to ith reference voltage output nodes during the control period, wherein the (k+1)th to ith resistance output-switching circuits electrically connect the (k+1)th to ith divided nodes with the (k+1)th to ith reference voltage output nodes after the control period has elapsed, wherein the second operational amplifier circuit outputs a voltage generated by adding a given offset voltage to a voltage output from the (k+1)th voltage follower type operational amplifier, to the kth reference voltage output node during the control period, and wherein an operating current of the second operational amplifier circuit is limited or terminated after the control period has elapsed.

21. A display driver circuit comprising:

the reference voltage generation circuit as defined in claim 20;

a voltage select circuit which selects a voltage from multi-valued reference voltages generated by the reference voltage generation circuit based on grayscale data; and a signal electrode driver circuit which drives a signal electrode by using the voltage selected by the voltage select circuit.

22. A display driver circuit comprising:

the reference voltage generation circuit as defined in claim 1;

a voltage select circuit which selects a voltage from multi-valued reference voltages generated by the reference voltage generation circuit based on grayscale data; and a signal electrode driver circuit which drives a signal electrode by using the voltage selected by the voltage select circuit.

23. A display device comprising:

a plurality of signal electrodes, a plurality of scan electrodes intersecting the signal electrodes, pixels specified by the signal electrodes and the scan electrodes, the display driver circuit as defined in claim 22 which drives the signal electrodes, and a scan electrode driver circuit which drives the scan electrodes.

24. A display device comprising:

a display panel including a plurality of signal electrodes, a plurality of scan electrodes intersecting the signal electrodes, and pixels specified by the signal electrodes and the scan electrodes;

the display driver circuit as defined in claim 22 which drives the signal electrodes, and a scan electrode driver circuit which drives the scan electrodes.

25. A reference voltage generation circuit which generates multi-valued reference voltages for generating grayscale values which are gamma-corrected based on grayscale data, comprising:

a ladder resistance circuit which comprises a plurality of resistance circuits connected in series between first and second power supply lines to which first and second power supply voltages are respectively supplied, and outputs voltages of first to ith (i is an integer of two or more) divided nodes, which are formed by dividing the ladder resistance circuit by the resistance circuits, as first to ith reference voltages;

a first switching circuit group which changes impedance of the resistance circuits disposed between the first power supply line and the jth (j is a natural number) divided node among the plurality of resistance circuits; and a second switching circuit group which changes impedance of the resistance circuits disposed between the second power supply line and the kth ($1 \leqq j < k \leqq i$, k is an integer) divided node among the plurality of resistance circuits, wherein the first and second switching circuit groups decrease the impedance of the resistance circuits during a given control period in a drive period based on the grayscale data, and increase the impedance of the resistance circuits after the control period has elapsed.

26. A display driver circuit comprising:

the reference voltage generation circuit as defined in claim 25;

a voltage select circuit which selects a voltage from multi-valued reference voltages generated by the reference voltage generation circuit based on grayscale data; and a signal electrode driver circuit which drives a signal electrode by using the voltage selected by the voltage select circuit.

27. A display device comprising:

a plurality of signal electrodes, a plurality of scan electrodes intersecting the signal electrodes, pixels specified by the signal electrodes and the scan electrodes, the display driver circuit as defined in claim 26 which drives the signal electrodes, and a scan electrode driver circuit which drives the scan electrodes.

28. A display device comprising:

a display panel including a plurality of signal electrodes, a plurality of scan electrodes intersecting the signal electrodes, and pixels specified by the signal electrodes and the scan electrodes;

the display driver circuit as defined in claim 26 which drives the signal electrodes; and a scan electrode driver circuit which drives the scan electrodes.

* * * * *